US011725834B2

(12) United States Patent
Biasotti et al.

(10) Patent No.: US 11,725,834 B2
(45) Date of Patent: Aug. 15, 2023

(54) WINDOW FRAME FOR AIR CONDITIONER UNIT AND AIR CONDITIONER UNIT FOR USE THEREWITH

(71) Applicant: The Air Lab, Inc., New York, NY (US)

(72) Inventors: Mark Biasotti, San Diego, CA (US); Josh Morenstein, San Francisco, CA (US); Florent Alexandre, San Francisco, CA (US); Ryan Figlia, New York, NY (US); Michael Mayer, New York, NY (US); David Hyun, San Francisco, CA (US)

(73) Assignee: THE AIR LAB, INC., New York, NY (US)

( * ) Notice: Subject to any disclaimer, the term of this patent is extended or adjusted under 35 U.S.C. 154(b) by 372 days.

(21) Appl. No.: 16/926,111

(22) Filed: Jul. 10, 2020

(65) Prior Publication Data

US 2021/0010688 A1 Jan. 14, 2021

Related U.S. Application Data

(60) Provisional application No. 62/873,599, filed on Jul. 12, 2019.

(51) Int. Cl.

| | |
|---|---|
| ***F24F 1/031*** | (2019.01) |
| ***F24F 13/32*** | (2006.01) |
| ***F24F 13/20*** | (2006.01) |

(52) U.S. Cl.

CPC ..... *F24F 1/031* (2019.02); *F24F 13/20* (2013.01); *F24F 13/32* (2013.01); *F24F 2221/20* (2013.01)

(58) Field of Classification Search

CPC .. F24F 1/031; F24F 13/20; F24F 13/32; F24F 2221/20

See application file for complete search history.

(56) References Cited

U.S. PATENT DOCUMENTS

| | | | | |
|---|---|---|---|---|
| D93,409 | S | 9/1934 | Keilholtz | |
| 2,682,159 | A | 6/1954 | Allen | |
| 2,814,244 | A * | 11/1957 | Hord | F24F 1/04 454/203 |
| D190,775 | S | 6/1961 | Nesbit | |
| 3,111,076 | A | 11/1963 | Martin, Jr. et al. | |
| 3,193,261 | A | 7/1965 | Nesbitt | |
| 3,204,690 | A | 9/1965 | Nyc | |
| 3,328,929 | A | 7/1967 | Mullins | |

(Continued)

*Primary Examiner* — Emmanuele E Duke
(74) *Attorney, Agent, or Firm* — Leason Ellis LLP

(57) ABSTRACT

A frame that is configured to hold a window air conditioner unit includes a main frame body having an opening formed therein for receiving the air conditioner unit. The frame includes a pair of adjustable side support frames that are slidingly coupled to the main frame body for filling a space between sides of the air conditioner unit and sides of the window frame. Each of the side support frames includes a take-up device for securing the frame within a window channel of the window frame. The take-up device has a fixed stop fixedly attached to the side support frame and an adjustable stop that is movable in a forward-rearward direction. The take-up device further includes an actuator that is accessible to a user along the main frame body and is configured to move the adjustable stop in the forward-rearward direction.

18 Claims, 33 Drawing Sheets

(56) References Cited

U.S. PATENT DOCUMENTS

| | | | | |
|---|---|---|---|---|
| 4,332,114 | A | 6/1982 | Goebel et al. | |
| 4,510,852 | A * | 4/1985 | Sorrentino | F24F 1/027 454/204 |
| D319,306 | S | 8/1991 | Yamazaki | |
| 7,350,759 | B1 * | 4/2008 | Gray | F24F 1/027 248/644 |
| D580,613 | S | 11/2008 | Yang | |
| 7,850,411 | B2 | 12/2010 | Solomon | |
| 9,303,895 | B1 * | 4/2016 | Grant | F24F 13/32 |
| 9,518,758 | B2 | 12/2016 | Lee | |
| 10,012,398 | B2 | 7/2018 | Swanson | |
| D849,220 | S | 5/2019 | Fang | |
| D919,780 | S | 5/2021 | Li | |
| 2018/0106484 | A1 | 4/2018 | Swanson et al. | |
| 2018/0313575 | A1 | 11/2018 | Paul | |
| 2021/0010688 | A1 | 1/2021 | Biasotti | |

* cited by examiner

WINDOW FRAME FOR AIR CONDITIONER UNIT AND AIR CONDITIONER UNIT FOR USE THEREWITH

CROSS REFERENCE TO RELATED APPLICATION

The present application claims priority to and the benefit of U.S. patent application Ser. No. 62/873,599, filed Jul. 12, 2019, which is hereby expressly incorporated by reference in its entirety.

TECHNICAL FIELD

The present invention relates to window air conditioners and more particularly, relates to a window frame that is for installation within a window and is configured to receive and hold an air conditioner unit, as well as an air conditioner unit that complements the window frame and is securely contained and held therein.

BACKGROUND

Window air conditioners are among the most popular types of air conditioning units. As is well known, a window air conditioner is one of the simpler forms of an air conditioning system and is mounted in a window or wall. The window air conditioner has an evaporator side that is located facing the room for cooling of the space and a condenser side outdoor for heat rejection. The window air conditioner is a single unit that is assembled in a casing where all the components are located.

A conventional window air conditioner has a front panel that is seen by the user from inside the room where it is installed and has a user interfaced control which can be electronic or mechanic in form. Older units usually are of mechanical control type with rotary knobs to control the temperature and fan speed of the air conditioner. The newer units come with electronic control system where the functions are controlled using remote control and touch panel with digital display. The front panel typically has adjustable horizontal and vertical (some models) louvers where the direction of air flow is adjustable to suit the comfort of the user(s).

Indoor side parts of the window air conditioner include, but are not limited to, a cooling coil with an air filter mounted on it. The cooling coil is where the heat exchange happens between the refrigerant in the system and the air in the room. The outdoor side parts of the window air conditioner include, but are not limited to, a compressor that is used to compress the refrigerant and a condenser coil that is used to reject heat from the refrigeration to the outside air.

Typically, the window air conditioner is installed using a mounting bracket that attaches to an outside wall and the underside of the window air conditioner. To fill the open space between casing and the window frame itself, accordion panels (accordion filler assemblies) are slid onto both sides of the window air conditioner. The window air conditioner is then placed onto the mounting bracket. The window is then lowered on top of the window air conditioner. The accordion panels are extended and screwed into place. The gap between the lower sash and the window pane can be filled with foam weather stripping. The window air conditioner is then plugged in and turned on and operated.

The above described installation process requires multiple parts and tools and involves the dangerous step of balancing the window air conditioner, which can be approximately 50 lbs. in weight, on a window sill. The present invention is directed providing an easier, safer alternative installation process that uses a window frame for the window air conditioner and further optionally includes a window air conditioner that is configured for use with the present window frame.

SUMMARY

An air conditioner frame for insertion into a window frame and configured to hold a window air conditioner unit includes a main frame having an opening formed therein for receiving the air conditioner unit. The frame also includes a pair of side support frames that are slidingly coupled to the main frame for filling a space between the air conditioner unit and sides of the window frame. The frame also has a drop-down shelf that is pivotally coupled to the main frame and moves between a lowered position in which the air conditioner unit is supported on the drop-down shelf and a raised position in which the drop-down shelf at least partially closes off the opening formed in the main frame.

In another aspect, a frame for insertion into a window frame and configured to hold a window air conditioner unit is provided and includes a main frame body having an opening formed therein for receiving the air conditioner unit. The frame including a pair of adjustable side support frames that are slidingly coupled to the main frame body for filling a space between sides of the air conditioner unit and sides of the window frame. Each of the side support frames includes a take-up device for securing the frame within a window channel of the window frame. The take-up device having a fixed stop fixedly attached to the side support frame and an adjustable stop that is movable in a forward-rearward direction. The take-up device further including an actuator that is accessible to a user along the main frame body and is configured to move the adjustable stop in the forward-rearward direction.

In another aspect, a method of installing an air conditioner unit into a window frame that includes a window channel defined by a first wall and a second wall parallel to the first wall, is provided and includes the steps of:

inserting an air conditioner unit frame into an opening defined in the window frame;

extending side support frames of the air conditioner unit frame until they contact jambs of the window frame, each extended side support frame defining an open space;

covering the open space of each side support frame; and using a take-up device to secure the frame within the window channel of the window frame, the take-up device having a fixed stop fixedly attached to a respective side support frame and an adjustable stop that is movable in a forward-rearward direction, the fixed stop being placed in contact with the first wall and the adjustable stop being adjusted until the adjustable stop contacts the second wall.

BRIEF DESCRIPTION OF THE DRAWING FIGURES

DETAILED DESCRIPTION OF CERTAIN EMBODIMENTS

Window Frame for Holding Air Conditioner Unit (First Embodiment)

Figure 12:
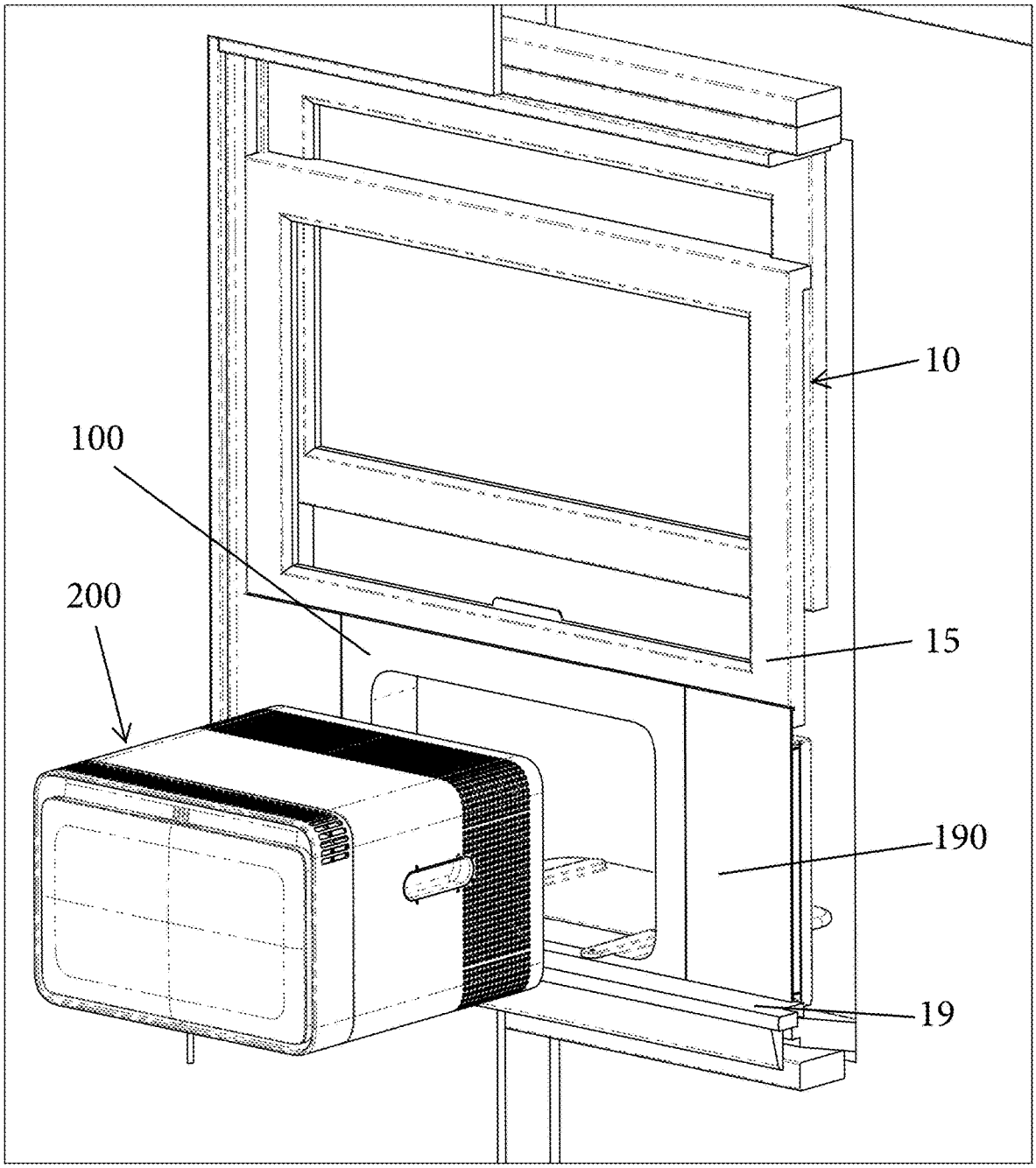
FIG. 12 is a front perspective view of the window frame installed into the window with the air conditioner unit being shown exploded from the window frame.
Figure 13:
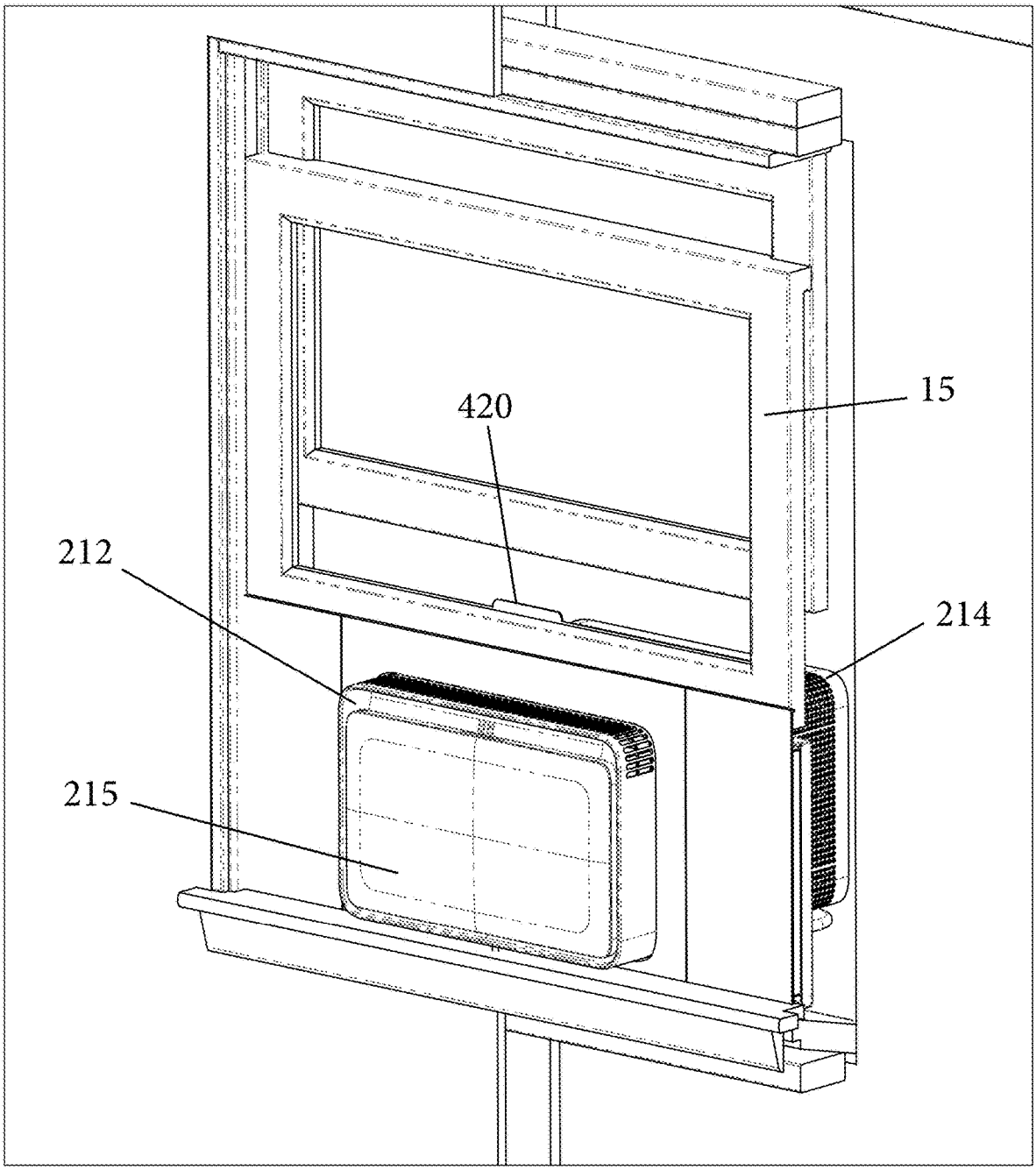
FIG. 13 is a front perspective view of the window frame installed into the window with the air conditioner unit being installed into the window frame.

FIGS. 1-13 illustrate a window frame 100 in accordance with one embodiment. The window frame 100 is configured to be installed into a conventional window 10 as shown in FIGS. 12-13. The window frame 100 has a main frame portion (main frame body) 110 that includes an opening (through hole) 120 for receiving an air conditioner unit 200, such as the one shown in FIGS. 9-11.

As illustrated the main frame portion 110 can have a rectangular shape and is defined by a top wall 112, an opposing bottom wall 114, a first side wall 116, and a second side wall 118 that define a forward section of the main frame portion 110.

As shown in the figures, the main frame portion 110 includes a sleeve or flange portion 130 that extends rearwardly and represents a rear section of the main frame portion 110 and also defines the opening 120. The main frame portion 110 and the flange portion 130 can be integrally formed as a single molded part. The sleeve portion 130 has a top wall 132, an opposing bottom wall 134, a first side wall 136, and a second side wall 138. The walls 112, 114, 116, 118 of the forward section of the main frame portion 110 and walls 132, 134, 136, 138 that define the sleeve portion 130 thus surround and define the border of the opening 120. The inner wall surfaces of the walls 112, 114, 116, 118 are continuous and seamless with the walls 132, 134, 136, 138 so as to form an uninterrupted inner wall surface that surrounds the air conditioner unit 200. As shown best in FIG. 3, the walls 112, 114, 116, 118 extend radially outward from the walls 132, 134, 136, 138 and thus, the walls 112, 114, 116, 118 represent the outer walls of the main frame portion 110.

Each of these walls that defines the opening 120 has a depth and in particular, each of these walls has an inner surface that faces and contacts the exterior of the air conditioner unit 200 as described herein. As shown, the corners of the opening 120, defined where the inner surfaces of walls 112, 114, 116, 118 and walls 132, 134, 136, 138 join one another, can be curved corners that have a degree of curvature. This is in contrast to conventional frames that have corners that are formed at 90 degrees (right angle corners). However, as described herein, the corners can alternatively be formed at right angles.

Figure 3:
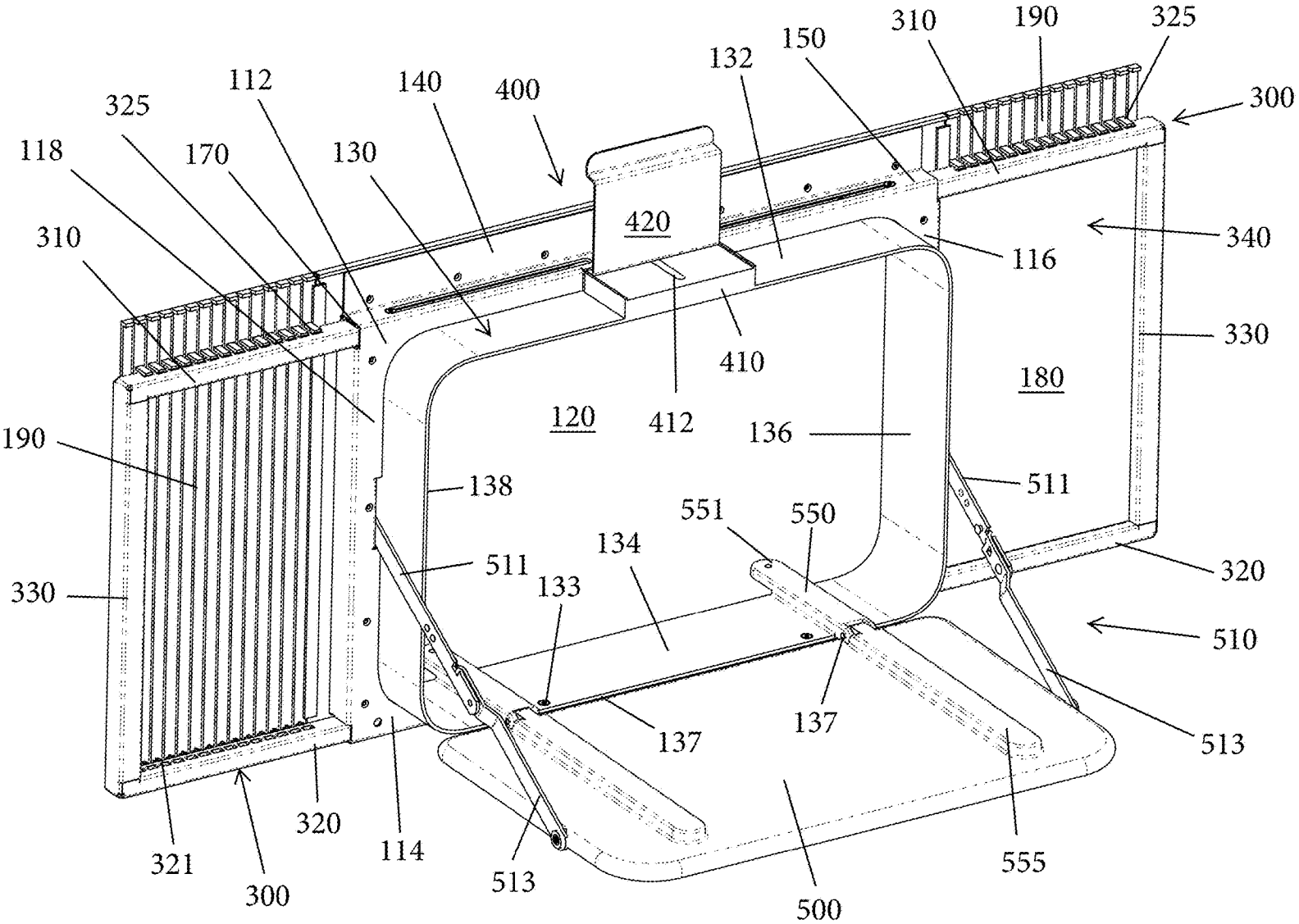
FIG. 3 is a rear perspective view thereof.
Figure 4:
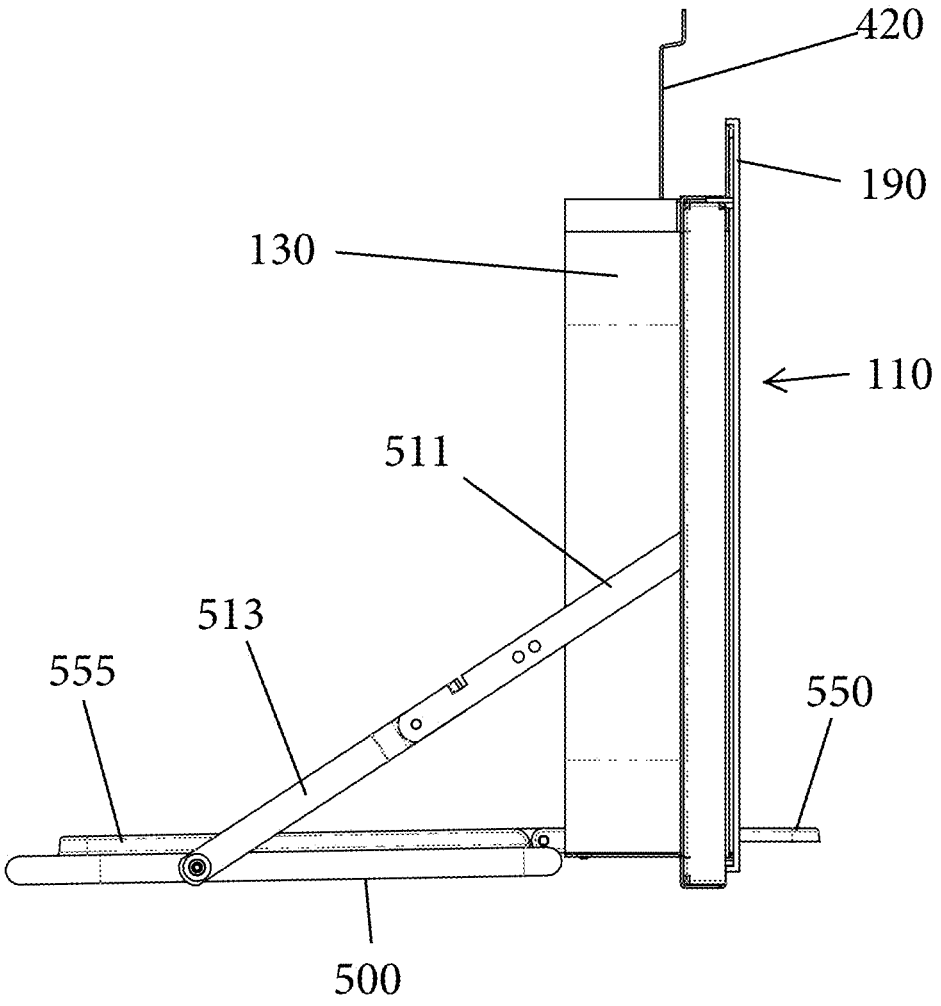
FIG. 4 is a side elevation view thereof.
Figure 5:
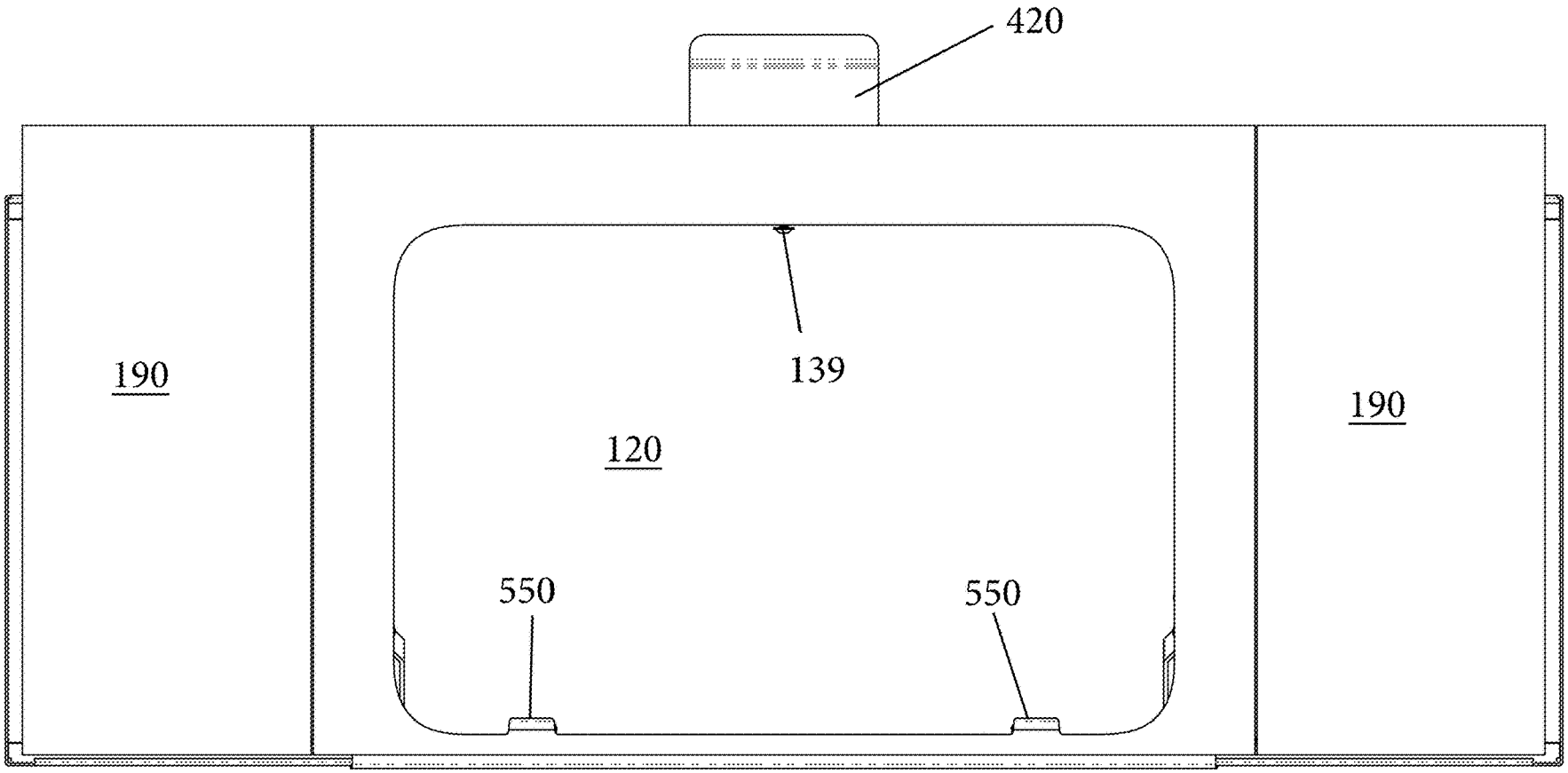
FIG. 5 is a front elevation view thereof.
Figure 6:
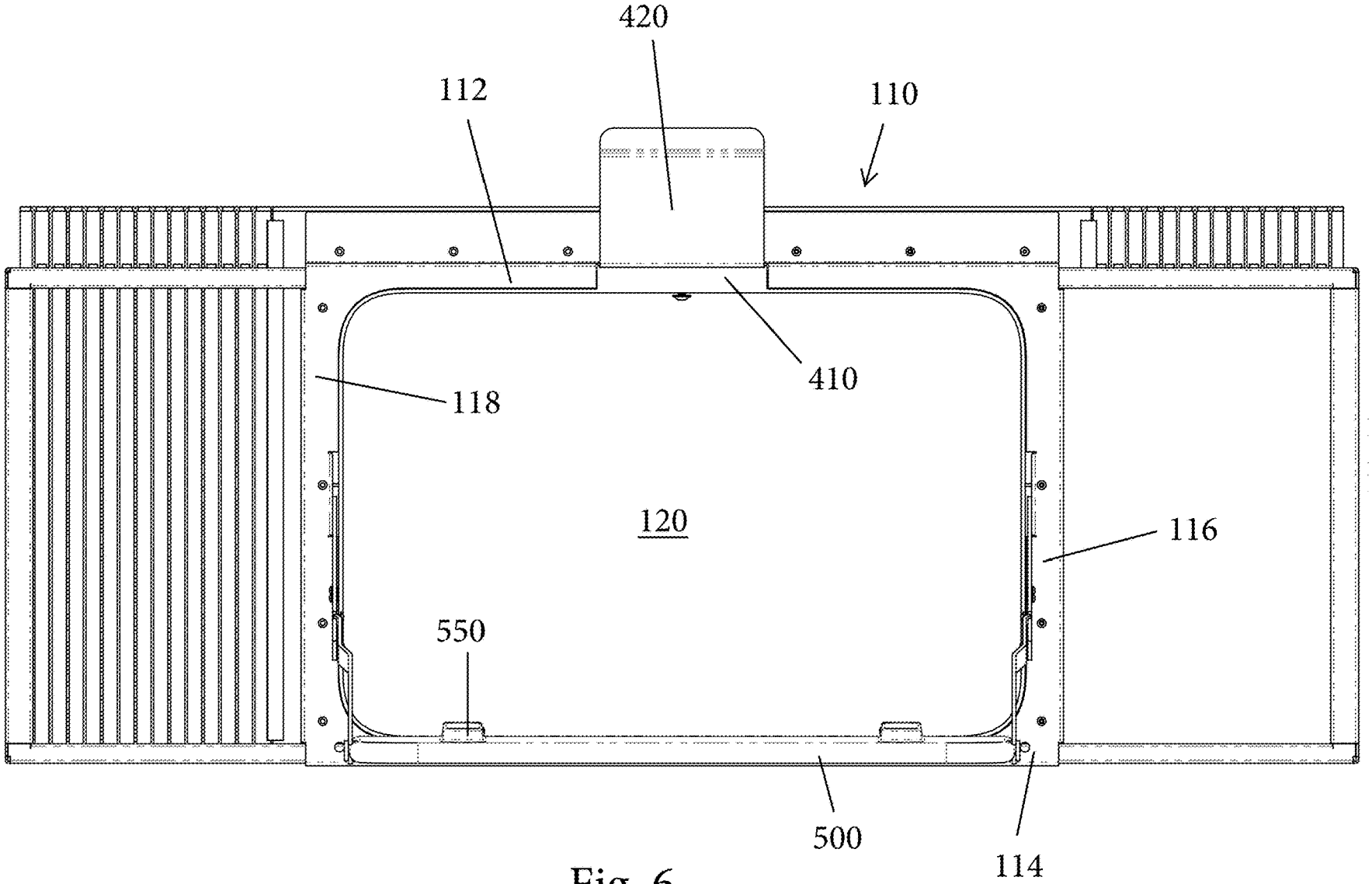
FIG. 6 is a rear elevation view thereof.

As best shown in FIG. 3, the top wall 112 of the forward portion of the main frame portion 110 has a stepped construction in that a forward section of the top wall 112 has an upstanding wall or flange or lip 140. Behind the upstanding wall 140 is a ledge 150 that can be formed at a right angle to the lip 140.

As shown, at least a portion of the top wall 112 lies above the top wall 132 of the sleeve portion 130 and similarly, at least a portion of the bottom wall 114 lies below the bottom wall 134.

Both the top wall 112 and the bottom wall 114 are hollow and each includes a hollow track space formed therein. As shown in FIG. 3, on each side of the top wall 112 and the bottom wall 134 there are openings 170. The openings 170 can take any number of shapes and sizes, with the illustrated openings 170 being generally rectangular shaped. These openings 170 and the hollow tracks (inner channels) formed in both the top wall 112 and bottom wall 114 receive adjustable side support frames 300. It will be understood that a single hollow channel or track can be formed completely through the top wall 112 from one side to the other side and thus, even though the term tracks in the plural sense may be used herein, it will be appreciated that only a single continuous inner channel (track) can be formed in the top wall 112 and the two side support frames 300 are inserted into the opposite ends of this continuous inner channel (track). Alternatively, there can be two separate discrete channel formed in the top wall 112 with one receiving one side support frame 300 and the other receiving the other side support frame 300. The same construction holds true for the inner track(s) (channel) formed through the bottom wall 114 and open along both sides thereof.

Generally, each side support frame 300 is designed to fill in the space between the side walls 112, 114 of the main frame portion 110 and the vertical sides 12 of the window 10 (FIGS. 8, 9, 12 and 13). Since this space can vary from window to window, each of the side support frames 300 is adjustable in that the side support frame 300 can slide laterally relative to the main frame portion 110 between a fully retracted position and a fully extend position.

As shown in the figures, each side support frame 300 can include upper and lower horizontal supports 310, 320 and an end support 330 that extends vertically between and connects to the upper and lower horizontal supports 310, 320. Between the upper and lower horizontal supports 310, 320 and the end support 330 there is an open space 340.

The upper horizontal support 310 is slidingly received within the hollow track formed in the top wall 112 and the lower horizontal support 320 is slidingly received within the hollow track formed in the bottom wall 114 as shown in FIG. 3. To extend or retract the side support frame 300, the user can manipulate the part as by placing his or her hand within the open space 340 and then either pull or push the end support 330 either toward or away from the main frame portion 110. The width of the top wall 112 and in particular, the length of the hollow track formed therein is such that in the fully retracted position, the upper horizontal supports 310 of both side support frames 300 are received therein. Similarly, the width of the bottom wall 114 and in particular, the length of the hollow track formed therein is such that in the fully retracted position, the lower horizontal supports 320 of both side support frames 300 are received therein.

Thus, each side support frame 300 slides within the body (track) of the window frame 100 and thus, the degree of which the side support frame 300 protrudes outwardly and laterally from the body of the window frame 100 can be controlled by the user. This provides for fit customization to allow the window frame 100 to fit into different sized windows.

The end support 330 is configured to be received within the side U-channel formed along the sides of the window 10. The reception of the end supports 330 into these U-channels thus serve to further locate and securely retain the window frame 100 in the window 10.

The construction and operation of the side support frames 300 are described in more detail below.

Figure 1:
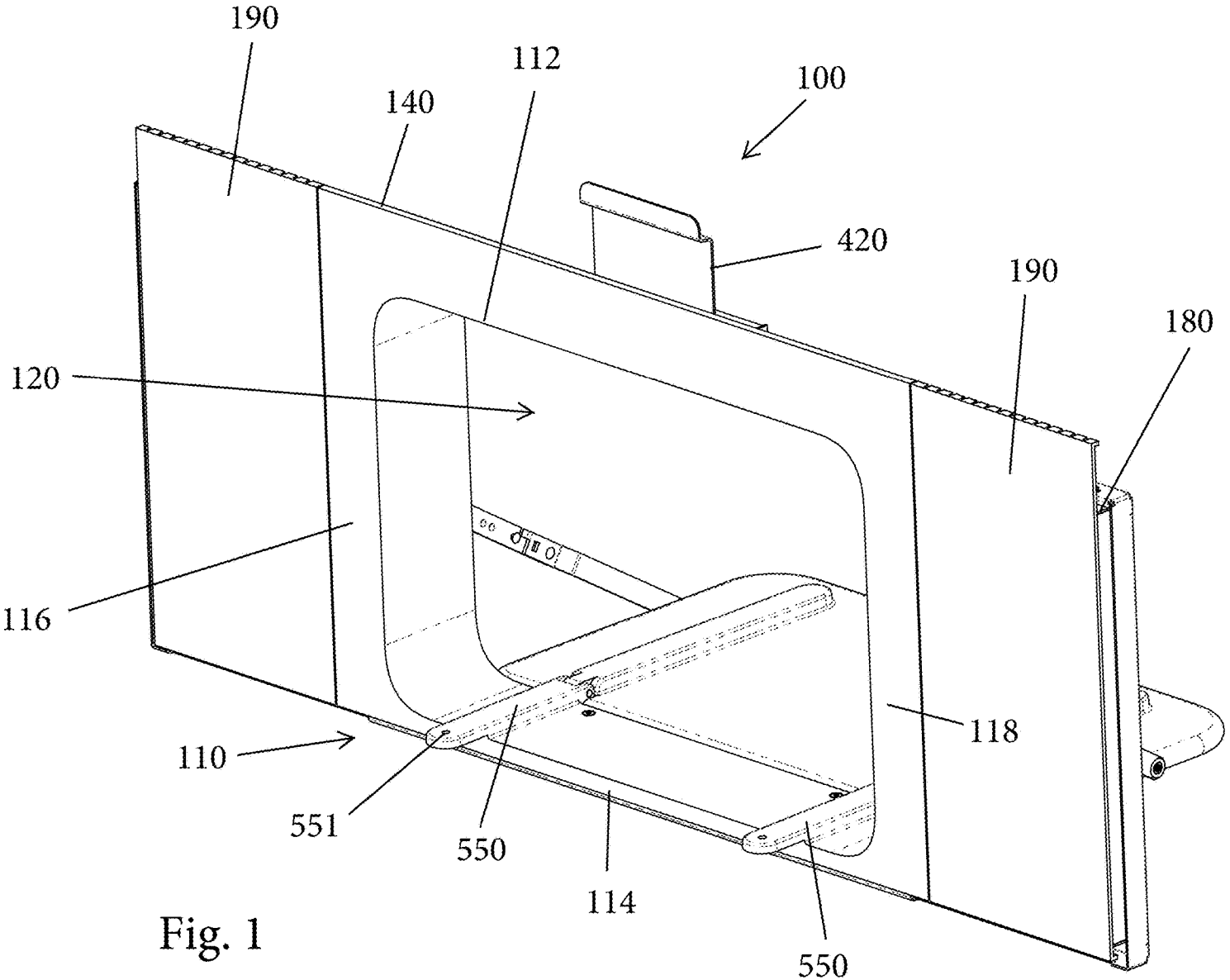
FIG. 1 is a front and side perspective view of a window frame according to a first embodiment with a pop-down shelf in an open position and side support frames in extended positions.
Figure 2:
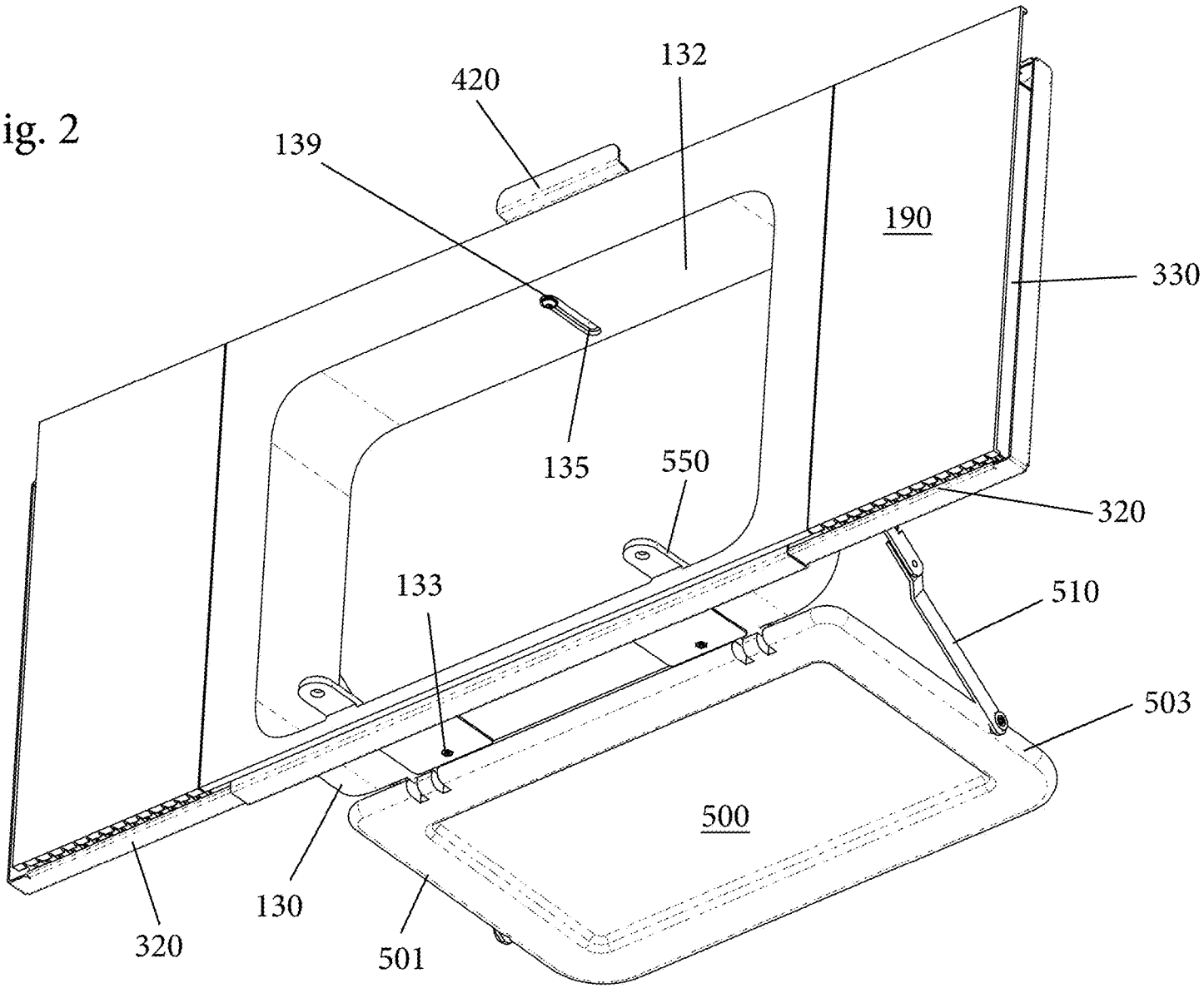
FIG. 2 is a front and bottom perspective view thereof.

The window frame 100 also includes an adjustable top bracket 400 that is disposed on and slides along a top exterior surface of the top wall 132 of the sleeve portion 130. The top bracket 400 includes a base 410 and an upstanding wall 420. The base 410 has a block-like shape and has a first elongated slot 412 formed therein. As shown in FIG. 2, the top wall 132 of the sleeve portion 130 also includes a second elongated slot 135 that is complementary to the first elongated slot 412 (FIG. 3). The first and second elongated slots 412, 135 at least partially overlap and receive a fastener 139 for securely attaching the top bracket 400 to the top wall 132 at its desired location. In other words, the sliding adjustment of the top bracket 400 allows the top bracket 400 to initially be pushed rearward away from the sash 15 of the window 10 to permit the sash 15 to be pulled downward and then the top bracket 400 can be slid forward until the upstanding wall 420 makes contact with the exterior of the sash 15 and then the top bracket 400 can be fixed in place using the fastener 139. The fastener 139 is thus configured to securely fix the top bracket 400 to the sleeve portion 130 at any number of given positions.

The upstanding wall 420 has a stepped construction in that the top of the wall 420 extends in a forward direction for a distance and then protrudes upwardly to its top edge. The upstanding wall 420 can generally be thought of as having an S shape. The top portion of the wall 420 is the part that seats against the exterior of the sash 15 of the window 10 as described herein. The top bracket 400 is designed to prevent someone from accidentally opening the window and to keep the air conditioner unit secure in the frame and window.

The window frame 100 also includes a pop-down shelf 500 that is coupled to the window frame 100 and moves between a lowered position and a raised position. The pop-down shelf 500 can be coupled to the window frame 100 using any number of techniques. For example, a pair of linkages 510 can be used to couple the pop-down shelf 500 to the window frame 100 and more particularly, to the main frame portion 110 or the sleeve portion 130 thereof. One linkage 510 is attached to a first side 501 of the pop-down shelf 500, while the other linkage 510 is attached to a second side 503 of the pop-down shelf 500 (FIG. 2). As illustrated, each linkage 510 can include a first part or first leg 511 and a second part of second leg 513. A first end of the first leg 511 is attached to the main frame portion 110 (and extends along the exterior of the sleeve portion 130), a first end of the second leg 513 is attached to respective side of the pop-down shelf 500 and second ends of the first leg 511 and the second leg 513 are pivotally attached to one another. The first end of the first leg 511 can be attached to a wing portion that extends from the front portion of the main frame portion 110 and is located exterior to the sleeve portion 130.

Figure 8:
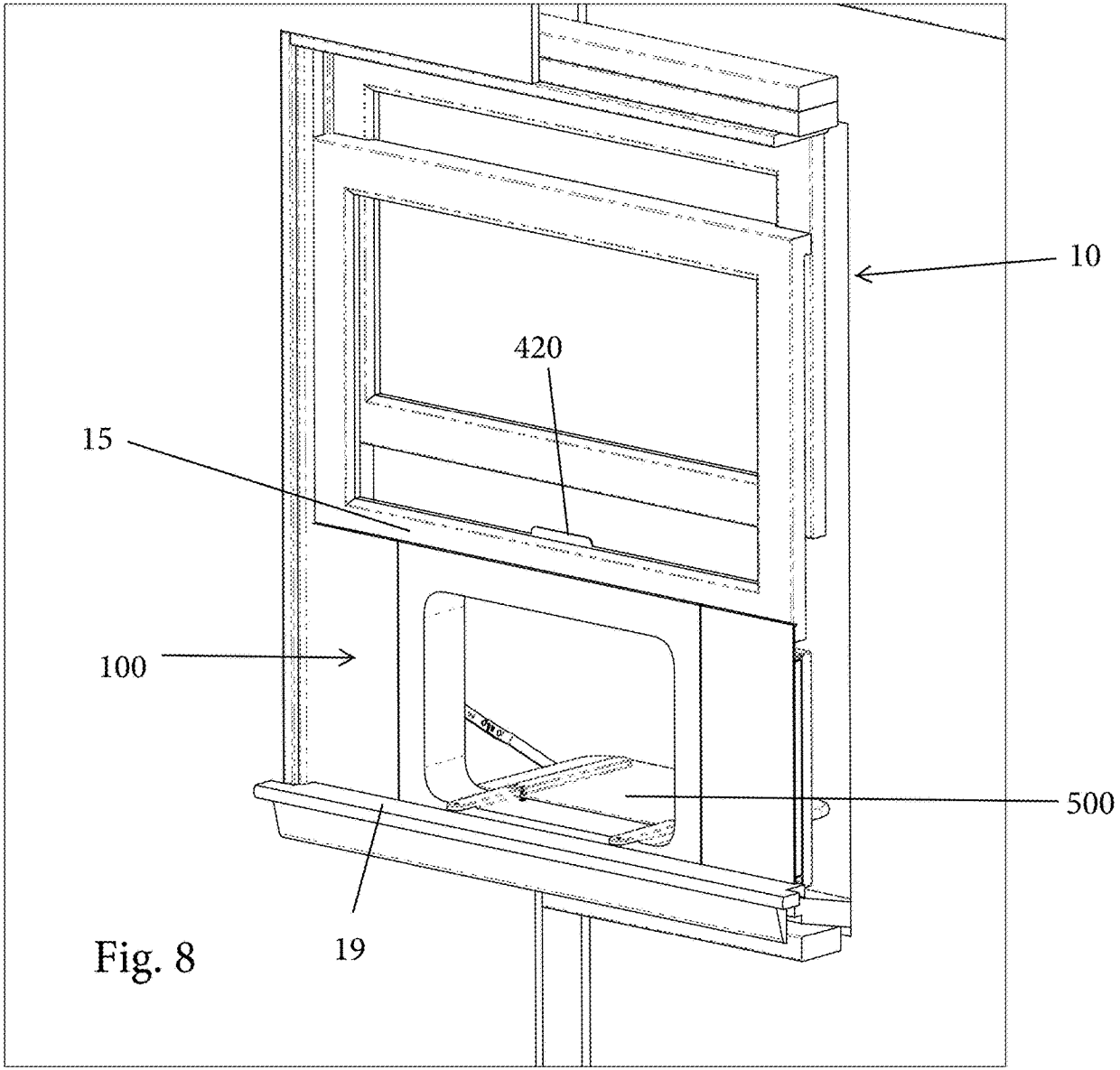
FIG. 8 is a front perspective view of the window frame installed into a window.
Figure 9:
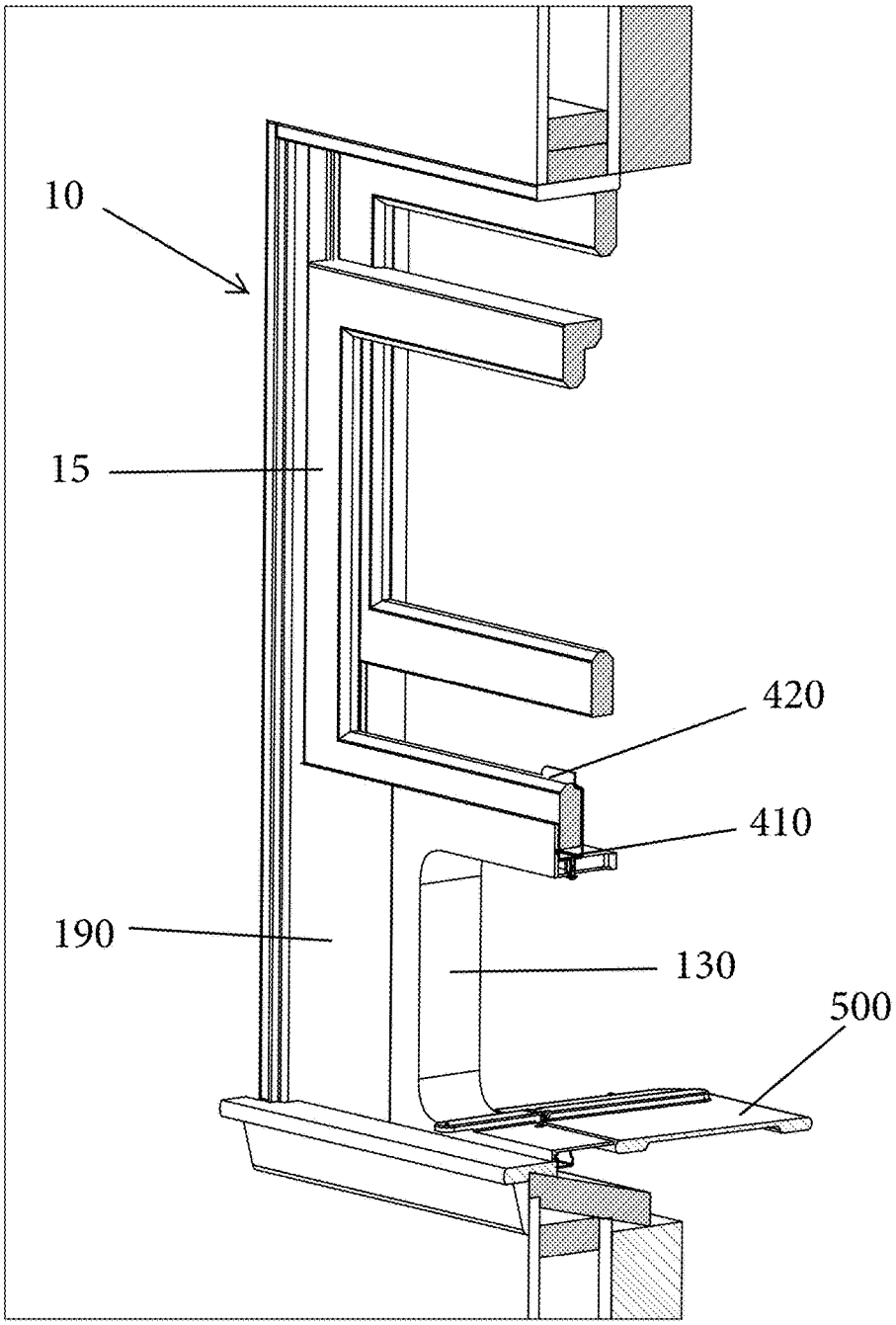
FIG. 9 is a perspective view, in cross-section, of a portion of the window frame installed into the window.

The construction of the linkages 510 is designed to allow controlled raising and lowering of the pop-down shelf 500. When the pop-down shelf 500 is in the fully lowered position, the first and second legs 511, 513 assume a linear configuration, while when the pop-down shelf 500 is in the fully raised position, the first and second legs 511, 513 assume a bent construction (FIG. 8). As shown, the linkages 510 lie external to the sleeve portion 130.

The pop-down shelf 500 can be a rectangular shaped substrate and preferably has a footprint (size) that is less than the open space 120.

A forward edge 520 of the pop-down shelf 500 can be hingedly attached to the bottom wall 134 of the sleeve portion 130. For example, there can be two hinges 137 that join the forward edge 520 of the pop-down shelf 500 to the bottom wall 134. In combination with the linkages 510, the hinges 137 serve to attach and control movement of the pop-down shelf 500 relative to the main frame portion 110. As illustrated and described herein, the hinges 137 can be part of raised rails 555 formed along the bottom wall 134.

The main frame portion 110 also includes a pair of forward extensions or fingers or tongues 550 that are located along the top surface of the bottom wall 114, 134. The forward extensions 550 are spaced apart and protrude forward of the front face of the main frame portion 110. Each of the forward extensions 550 thus extend a prescribed distance from the front face. The distal ends of the forward extensions 550 can be curved and an opening 551 can be formed therethrough. Each opening 551 is intended to receive a fastener that is used to secure the air conditioner unit 200 to the window frame 100

As shown, the forward extensions 550 can be elevated relative to the bottom wall 114, 134 and therefore, air conditioner unit can rest upon these extensions 550. As described herein, the custom air conditioner unit 200 can include complementary features to allow mating between the air conditioner unit 200 and the forward extensions 550. As shown in FIGS. 2 and 3, the bottom wall 134 of the sleeve portion 130 can include fasteners 133 that can be used to attach the air conditioner unit 200 to the window frame 100

In other embodiment, the forward extensions 500 are not elevated relative to the bottom wall 114, 134 and therefore, the bottom wall 114, 134 is flush and planar.

In the fully lowered position, the pop-down shelf 500 can be located in a plane that can be generally formed at angle other than 90 degrees to a vertical plane that contains the front face of the main frame portion 110 and more particularly, the shelf 500 preferably slightly slopes downward to facilitate drainage of the air conditioner unit. For example, the shelf 500 can have a 1 (one) degree pitch in the downward direction when it is placed in the fully lowered position. This allows the air conditioner unit 200 to rest in a desired orientation on both the bottom wall 134 and the pop-down shelf 500.

Along the exposed rear edge of the shelf 500 there can be a raised protrusion (rail) that acts as a safety backstop in that this raised edge limits the rearward movement of the air conditioner unit on the shelf 500. This feature is illustrated and discussed in more detail below with respect to the window frame according to the second embodiment.

As illustrated herein, the pop-down shelf 500 can also include a built-in bracket. In particular, the center of the pop-down shelf 500 can include an opening in which built-in bracket can be pivotally disposed such that in the raised position, the built-in bracket lies in the same plane as the pop-down shelf 500. When the built-in bracket pivots downward relative to the shelf 500 it is exposed and is available to be placed against an outside wall that contains the window 10. In particular, the built-in bracket is pivotally attached to the shelf 500 closer to the rear free edge of the shelf 500 and pivots downward so that the lowered edge of the built-in bracket can seat against the exterior wall that contains the window 10. In this way, the built-in bracket serves to support and hold the shelf 500 in the lowered position and also acts as weight bearing support when the air conditioner unit 200 is placed on the shelf 500. It will therefore be appreciated that there are any number of built-in brackets that can be used and can be fastened or attached to provide additional support.

The window frame 100 also contains insulation 180 and protective covering 190 that is disposed within the open space 340 of each side support frame 300. More particularly, insulation 180 (FIG. 1) can be disposed within the open space 340 (FIG. 3) and can take any number of forms (such as sheet, panel or block form) and can be formed of any number of suitable insulation materials, such as foams, etc. In addition, the insulation 180 can be in the form of a laminate and include an outer decorative layer and an inner insulation layer. The outer decorative layer presents a visually different appearance than the inner insulation layer can be formed of a different material. However, both the outer decorative layer and the inner insulation layer can be cut or otherwise reduced in dimension to fit the open space in the extended side support frame 300.

In addition, the window frame 100 includes covering 190 that is designed to provide a protective and decorative cover over the insulation 180. The covering 190 thus provides an aesthetically pleasing look while also shielding the insulation 180.

In accordance with the present disclosure, the covering 190 can come in sheet form and as shown, can be formed of a number of strips that are attached in a side-by-side manner and can be (vertically) perforated to allow the covering 190 can be cut to size (customized). In other words, the covering 190 is cut to size by cutting along a perforation (cut line) between two strips or can simply be detached along a scored line (perforation/weakened area of the sheet). The strips of the covering 190 preferably have a height that is greater than a height of the side support frame 300. Thus, when properly installed, the covering 190 extends from the lower horizontal support 320 to a location above the upper horizontal support 310 and more particularly, the covering 190 extends to the upstanding wall or flange or lip 140 to provide a clean look along the front face of the window frame 100. In other words, the top edge of the covering 190 and the top edge of the lip 140 are coplanar.

Any number of techniques can be used to attach the covering 190 to the side support frame 300. For example, along the rear of the covering 190, there are one or more areas of clips or fasteners 325. The clips 325 extend rearwardly from the covering 190 and are configured to engage a complementary locking feature formed as part of the side support frame 300. In particular, the top surface of the upper horizontal support 310 can include an elongated rail with ridges (ribbed rail) that are formed side-by-side along the top surface of the upper horizontal support 310 and into which the clips 325 are received in a locking manner. In other words, one clip 325 is snap-fittingly received between two ridges (raised protrusions) (not shown). Similarly, the lower horizontal support 320 can include a ribbed rail for receiving clips 325 or the like. In this way, the customized (cut-to-size) covering 190 can be easily snap-fittingly attached to the side support frame 300 by engaging male/female locking features, in this case, clips 325 and ribbed rail. The male feature is the clip (which can be considered to be a protrusion) and the female feature is the space between two ridges. The clips have sufficient flexibility to be pressed into these spaces between the ridges to form a friction fit.

Figure 7:
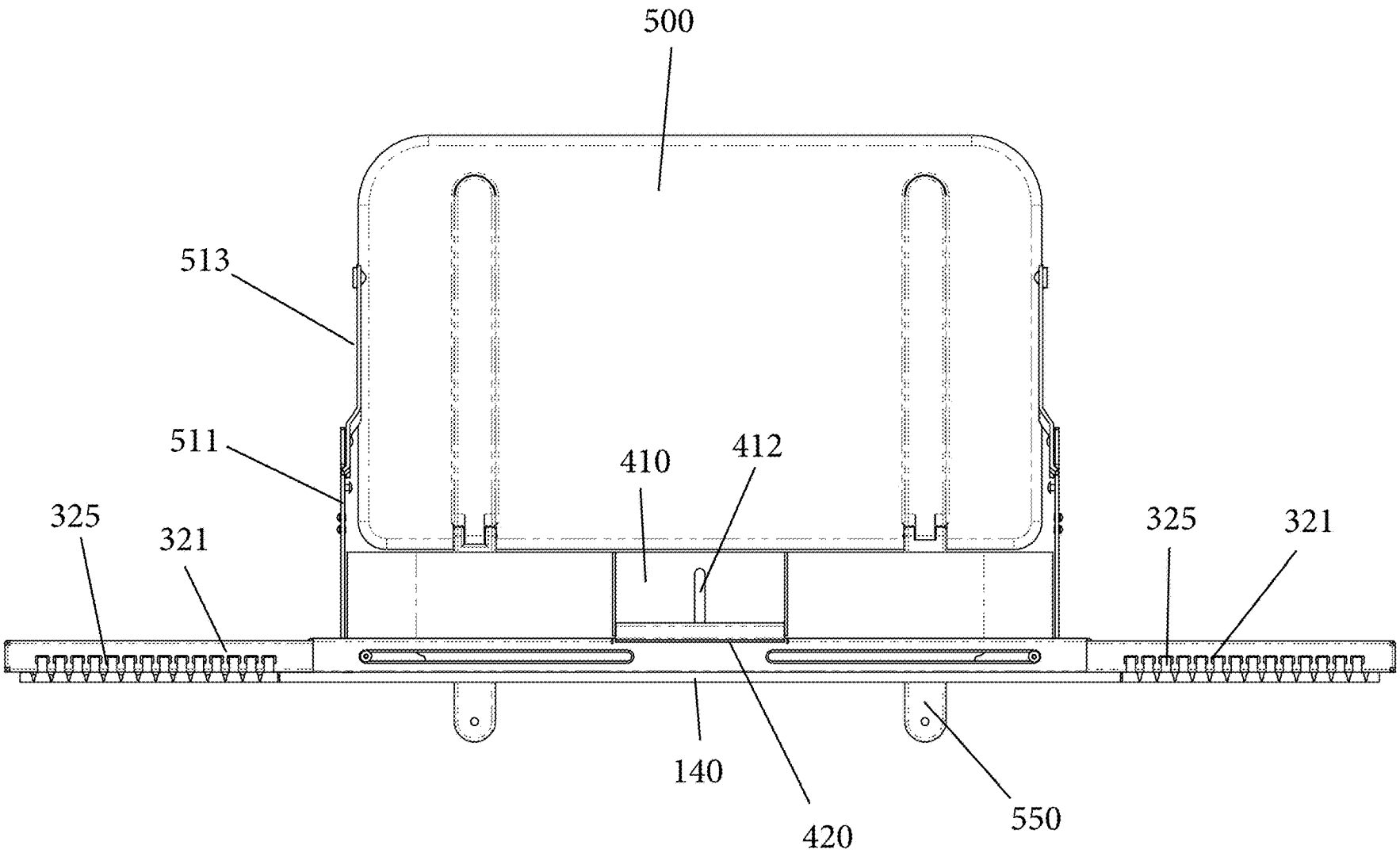
FIG. 7 is a top plan view thereof.

Alternatively, the top surface of the upper horizontal support 310 can include openings 321 or a single continuous slot into which the clips 325 are received in a locking manner. For example, the clip 325 can have a locking tab and have a prong-like shape in which the locking tab of the clip (a male feature) enters and catches on and is retained on an edge of a respective opening 321 (or the continuous slot). Similarly, the lower horizontal support 320 can include openings 321 for receiving clips 325 or the like. In this way, the customized (cut-to-size) covering 190 can be easily snap-fittingly attached to the side support frame 300 by engaging male/female locking features, in this case, clips 325 and openings or slots 321. For example, in FIG. 7, it can be seen that the two horizontal supports 310, 320 have a series of openings 321 formed therein. Along the rear face of the covering 190 and more particularly along the rear face of each of the segmented covering sections (elongated perforated sections), there can be an upper clip 325 and a lower clip 325. In one exemplary assembly pattern, the bottom clip 325 has an extension that protrudes from the rear of the covering section 190 and has an upturned protrusion or lip that is received within the bottom of one opening 321 along the lower horizontal support 320 (this action can be thought of as a hooking type action) in which the bottom portion of the covering is hooked onto the lower horizontal support 320). Then as shown in FIG. 7, the top clip 325 which can consist of extension protruding rearward with downwardly extending protrusions or lips are snap-fittingly inserted into the openings 325 formed along the upper horizontal support 310. In this cap, the bottom clip 325 are first engaged and then the top clips 325 are engaged; however, the opposite process is possible as well.

The adjustable side panel supports 300 are thus designed to fill the open space between the air conditioner unit and the sides of the windows. The coverings 190 likewise decoratively cover this space as well.

In particular, along the rear of a plurality, and preferably along all, of the covering strips there are clips 325.

It will be appreciated that the covering 190 is easily detached and can be interchanged with over coverings 190 and therefore, the user can easily customize the window frame 100. For example, the coverings 190 can come in different colors, different patterns, having different prints formed thereon, have different textures, etc. While the default color of the covering 190 is the same color as the window frame 100, other colors can be offered to provide a contrast in the color of the coverings 190 and the rest of the window frame 100.

The foam 180 can be tear-away weatherproof foam and the covering 190 can be made of a plastic material.

Air Conditioner Unit (First Embodiment)

It will be appreciated that the window frame 100 described is configured for use with existing air conditioner units and therefore can come in different shapes and sizes to accommodate such existing air conditioner units. In other words, the window frame 100 can be distributed as an accessory product for use with a window air conditioner unit that is presently owned by the consumer. It is expected that the window frame 100 will therefore come in different product lines suitable for air conditioner units that have different constructions (sizes, shapes, etc.).

Figure 10:
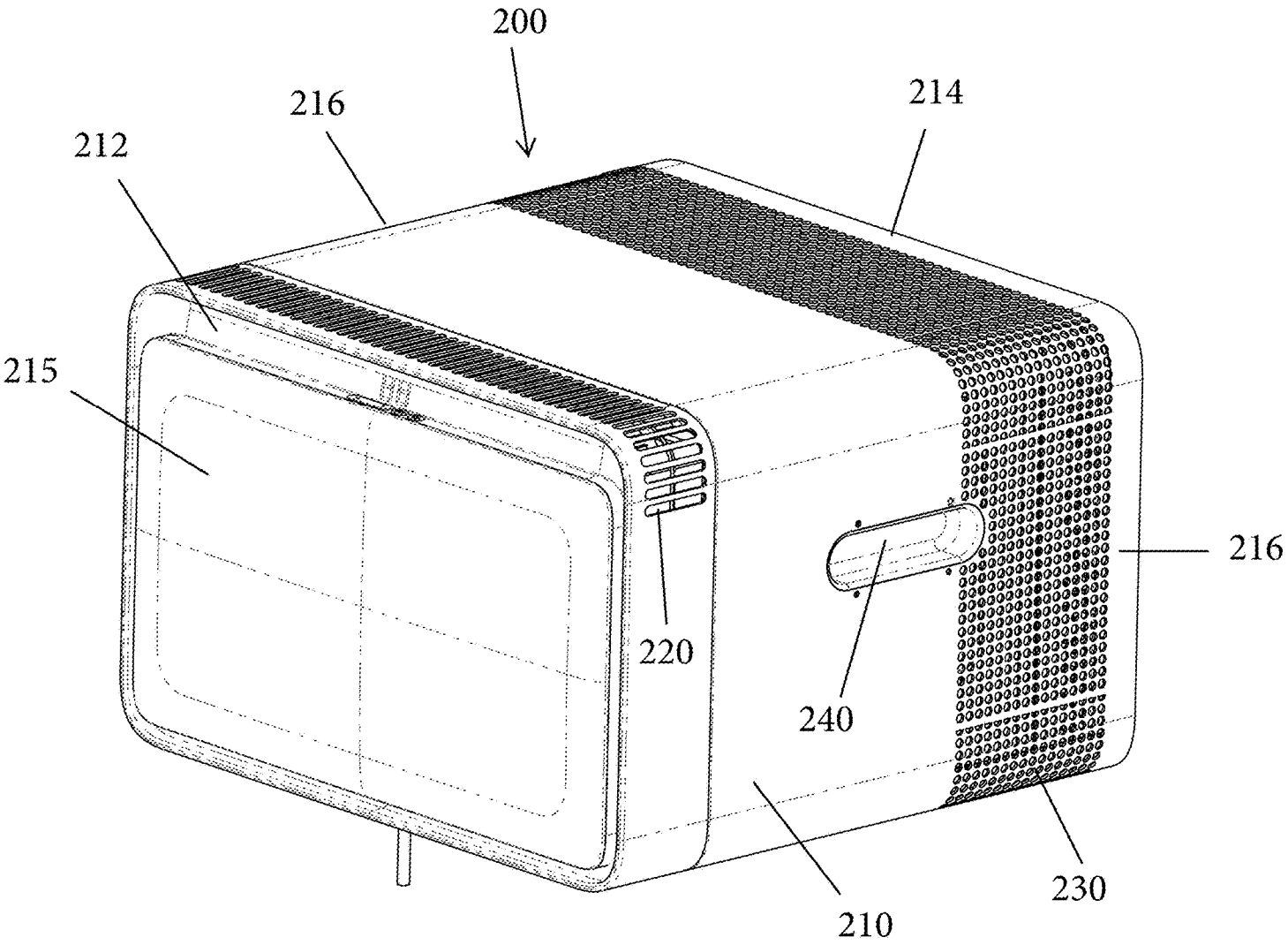
FIG. 10 is a front and side perspective view of an exemplary air conditioner unit.
Figure 11:
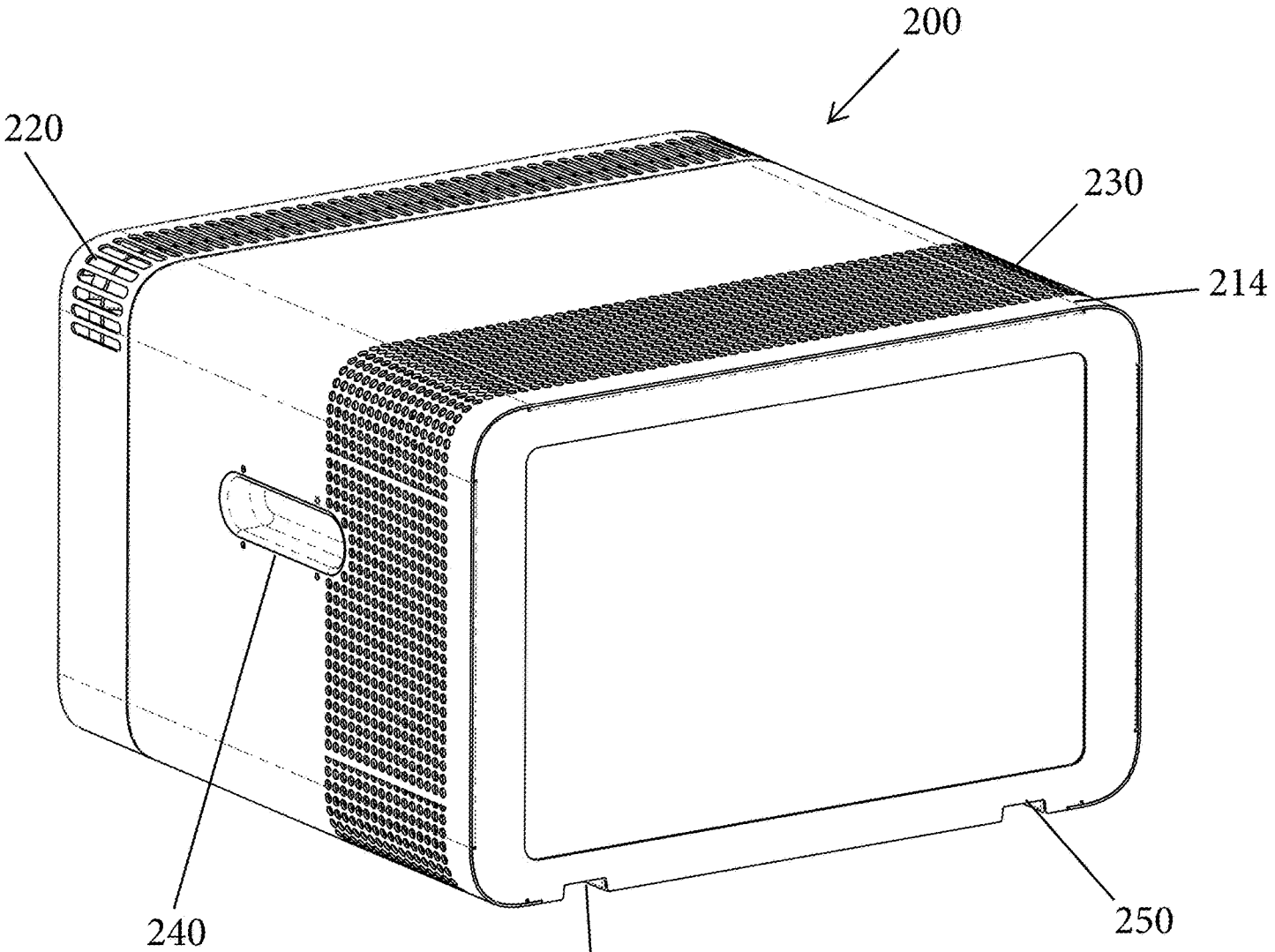
FIG. 11 is a rear and side perspective view thereof.

It will also be appreciated that the window frame 100 can be used with the specially designed (custom) air conditioner unit 200 that is shown in FIGS. 10-11. The air conditioner unit 200 is designed to mate with and be securely held and retained within the window frame 100. However, it will equally be understood that the window frame 100 can be used with other air conditioner units and therefore, is not limited to use with only the air conditioner unit 200 shown in the figures.

The air conditioner unit 200 has a casing 210 that has a front portion 212, a rear portion 214 and two sides 216. The front 212 has a front face 215 that can include a user interface and other controls. The front portion 212 also can include front vents 220. The rear portion 214 can also include rear vents 230. As shown, the front vents 220 and the rear vents 230 can have different shapes and sizes. It will also be appreciated that the vents 220, 230 can be formed in any number of different patterns, etc.

Since the opening 120 preferably has curved corners, as discussed herein, the casing 210 has complementary curved corners so that when the air conditioner unit 200 is received within opening 120, it sealingly mates with the inner surface of the window frame 100. However, as discussed herein, the opening 120 can have any number of different shapes and can be right angled edges. It will also be appreciated that the sleeve 130 can even include a seal element, such as a gasket (O-ring) that extends along the inner surface of the sleeve 130 and intimately contacts the air conditioner unit 200 when it is inserted through the opening 120 and seats against the sleeve 130. Thus, a sealed fit is desired between the air conditioner unit 200 and the frame 100 with or without the use of a gasket.

The sides 216 of the casing 210 can include recessed portions 240 that serve as handles for carrying the air conditioner unit 200.

As best shown in FIG. 11, the bottom of the casing 210 (at least in the rear portion 214) can include a pair of notches (slots or channels) 250 that receive the forward extensions 550 as well as the raised rails 555 formed along the bottom wall 134. The notches 250 and extensions 550/rails 555 thus represent a male/female coupling mechanism that acts is a guide for insertion of the air conditioner unit 200 into the window frame 100 and prevents lateral movement of the air conditioner unit 200 within the casing 210.

The window frame 100 can be packaged together with the air conditioner unit 200 or can be separately distributed and purchased.

Exemplary Installation Process

FIGS. 8, 9, 12 and 13 show installation of the window frame 100 into the window 100. The sash 15 is raised to allow insertion of the window frame 100. The side support frames 300 are first in a retracted position and the shelf 500 is in the raised position. The window frame 100 is placed over the sill 19 into the window opening. The sash 15 is lowered and is disposed within the space between the top bracket 400 and the exterior face of the sash 15. In particular, the sash 15 seats against the top of the base 410 and the ledge 150. The window 10 also includes jambs 13 that are the vertical sides of the window.

A pair of fasteners (such as a thumb screw) can be located along the front wall 140 and pass through holes formed therein and when tightened, the fasteners are driven into contact with the side support frames 300 that are received within the hollow tracks formed in the main frame portion 110. A friction fit is formed in this way and thus provides a mechanism for securely tightening the side support frames 300 in place once the side support frames 300 are in the desired extended position within the U-channels of the window 10.

Then the side support frames 300 are extended and locked in place, in the U-channel of the windows on either side, before then inserting the insulation 180 and coverings 190. The insulation 180 and covering 190 can be installed before or after the air conditioner unit 200 is inserted into the window frame 100.

The user lowers the shelf 500 by simply pressing and applying a rearward directed force to the shelf 500 causing it to lower to the lowered position. If the shelf 500 include a built-in bracket, this bracket is also extended and lowered by pushing the built-in bracket away from the shelf 500. It will also be appreciated that such a built-in bracket can be attached using any number of fastening techniques and then lowered into place. It will therefore be appreciated that the shelf 500 can have an attachment point for external support, in situations where customer needs additional support.

In the lowered shelf position, the top bracket 400 can be adjusted by placing his/her hand up into contact with the top bracket 400 and then pushing the top bracket 400 forward until the wall 420 of the top bracket 400 makes contact with the lowered sash 15. The top bracket 400 is then locked in place by tightening the fastener 139.

The air conditioner unit 200 is then inserted into the window frame 100 using handles 240. When present, the notches 250 are aligned with the forward extensions 550 and the air conditioner unit 200 is slid rearward over the extensions 550/rails 555, which are received within the notches 250.

It will be appreciated that any number of different locking mechanisms can be used to detachably lock or couple the air conditioner unit 200 to the window frame 100. For example, fasteners can be used or other means can be used. For example, a fastener can pass through the sleeve portion 130 into a locking hole formed in the casing 210 of the air conditioner unit 200. The fastener can be a thumbscrew that is tightened and thereby locks the air conditioner unit 200 to the window frame 100 (i.e., the sleeve portion 130).

Window Frame for Holding Air Conditioner Unit (Second Embodiment)

Now turning to FIGS. 14-32 which illustrate a window frame (air conditioner unit frame) 600 for holding an air conditioner unit 1000 (FIGS. 23 and 24) within a standard window 10. The window frame 600 is similar to the window frame 100 and therefore, like elements are numbered alike in the window frame 600 of FIGS. 14-32 compared to the window frame 100 of the FIGS. 1-13. As described herein, many of the basic components are shared between both the window frame 600 and the window frame 100.

It will also be understood that window 10 is one exemplary type of window and it is within the scope of the present disclosure that the window frames 100, 600 can be modified for use with other types of windows.

The window frame 600 is defined by a main frame portion 610 and can have a rectangular shape and is defined by the top wall 112, the opposing bottom wall 114, the first side wall 116, and the second side wall 118 that define a forward section of the main frame portion 110. The main frame portion 610 has a through hole or opening 120.

As shown in the figures, the main frame portion 110 includes the sleeve or flange portion 130 that extends rearwardly and represents a rear section of the main frame portion 110 and also defines the opening 120. The air conditioner unit passes through opening 120 and thus, seats against the main frame portion 110 and the sleeve 130. The sleeve portion 130 thus provides additional surface area on which the air conditioner unit can rest as well as provided additional enclosure around the air conditioner unit.

The sleeve portion 130 is defined by the top wall 132, the opposing bottom wall 134, the first side wall 136, and the second side wall 138. The walls 112, 114, 116, 118 of the forward section of the main frame portion 110 and walls 132, 134, 136, 138 that define the sleeve portion 130 thus surround and define the border of the opening 120. As shown, the sleeve portion 130 has curved corners; however, it can be formed to have right angle corners as well. As discussed herein, the shape of the sleeve portion 130 is configured in large part based on the shape of the air conditioner unit 1000 since the air conditioner unit 1000 sits within the sleeve portion 130.

The inner wall surfaces of the walls 112, 114, 116, 118 are continuous and seamless with the walls 132, 134, 136, 138 so as to form an uninterrupted inner wall surface that surrounds the air conditioner unit 200. As shown best in FIGS. 14 and 15, the walls 112, 114, 116, 118 extend radially outward from the walls 132, 134, 136, 138 and thus, the walls 112, 114, 116, 118 represent the outer walls of the main frame portion 610.

Each of these walls that defines the opening 120 has a depth and in particular, each of these walls has an inner surface that faces and contacts the exterior of the air conditioner unit 1000 as described herein. As shown, the corners of the opening 120 defined where the inner surfaces of walls 112, 114, 116, 118 and walls 132, 134, 136, 138 join one another can be curved corners that have a degree of curvature. This is in contrast to conventional frames that have corners that are formed at 90 degrees (right angle corners). However, as described herein, the corners can alternatively be formed at right angles.

Figure 15:
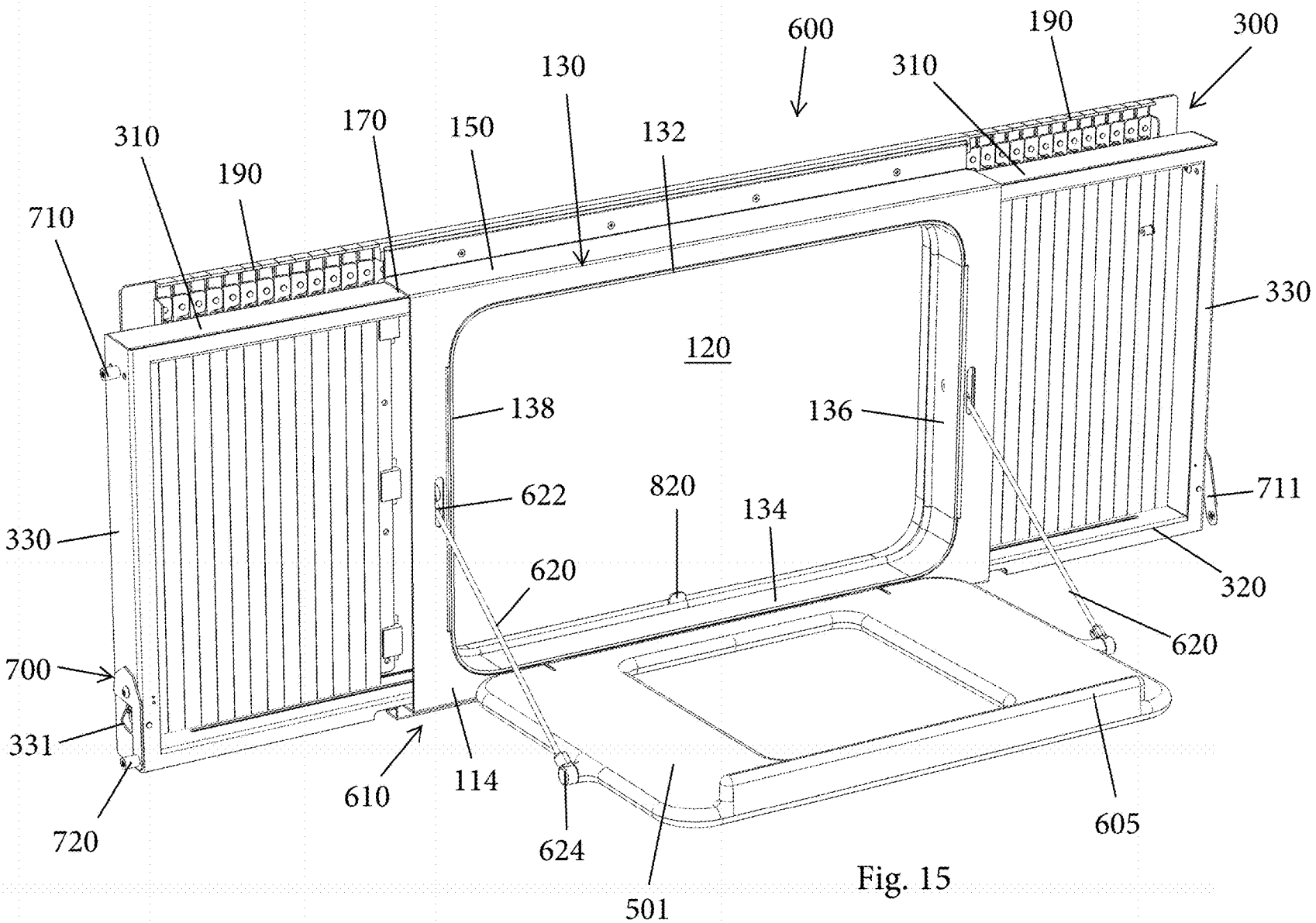
FIG. 15 is a rear perspective view thereof.

As best shown in FIG. 15, the top wall 112 of the forward portion of the main frame portion 610 has a stepped construction in that a forward section of the top wall 112 has an upstanding wall or flange or lip 140. Behind the upstanding wall 140 is a ledge 150 that can be formed at a right angle to the lip 140.

As shown, at least a portion of the top wall 112 lies above the top wall 132 of the sleeve portion 130 and similarly, at least a portion of the bottom wall 114 lies below the bottom wall 134.

Both the top wall 112 and the bottom wall 114 are hollow and each includes a hollow track space formed therein. As shown in FIG. 15, on each side of the top wall 112 and the bottom wall 114 there are openings 170 that are in the form of entrances into an open track space formed within the main body 610. The openings 170 can take any number of shapes and sizes, with the illustrated openings 170 being generally rectangular shaped. These openings 170 and the hollow track (channel) formed in both the top wall 112 and bottom wall 114 receive the adjustable side support frames 300. The side support frame 300 fills in the open space formed between the side walls 116, 118 of the main frame portion 110 and the vertical sides 12 of the window 10. Since this space can vary from window to window, each of the side support frames 300 is adjustable in that the side support frame 300 can slide laterally relative to the main frame portion 610 between a fully retracted position and a fully extend position.

As shown in the figures, each side support frame 300 can include upper and lower horizontal supports 310, 320 and an end support 330 that extends vertically between and connects to the upper and lower horizontal supports 310, 320. Between the upper and lower horizontal supports 310, 320 and the end support 330 there is an open space 340.

The upper horizontal support 310 is slidingly received within the hollow track formed in the top wall 112 and the lower horizontal support 320 is slidingly received within the hollow track formed in the bottom wall 114 as shown in FIG. 3. To extend or retract the side support frame 300, the user can manipulate the part as by placing his or her hand within the open space 340 and then either pull or push the end support 330 either toward or away from the main frame portion 110. The width of the top wall 112 and in particular, the length of the hollow track formed therein is such that in the fully retracted position, the upper horizontal supports 310 of both side support frames 300 are received therein. Similarly, the width of the bottom wall 114 and in particular, the length of the hollow track formed therein is such that in the fully retracted position, the lower horizontal supports 320 of both side support frames 300 are received therein. In the fully retracted position, the end supports 330 seat against the sides 116, 118 of the main body 610.

Thus, each side support frame 300 slides within the body (track) of the window frame 100 and thus, the degree of which the side support frame 300 protrudes outwardly and laterally from the body of the window frame 100 can be controlled by the user. This provides for fit customization to allow the window frame 100 to fit into different sized windows. In other words, the side support frames 300 are extended until the end supports 330 contact the jambs 13 of the window 10.

Unlike traditional window mounted air conditioners, the side support frames 300 are designed so as to travel internally within the main body 610 as opposed to collapsing on top of itself due to a bellows type construction as in traditional air conditioner units.

The end support 330 is thus configured to be received within the side U-channel formed along the sides (jambs 13) of the window 10. The reception of the end supports 330 into these U-channels thus serve to further locate and securely retain the window frame 100 in the window 10.

The construction and operation of the side support frames 300 are described in more detail below as well as a take-up device 700 that is associated with the side support frame 300 and serves to secure and stabilize the entire window frame 600 within window 10.

Figure 29:
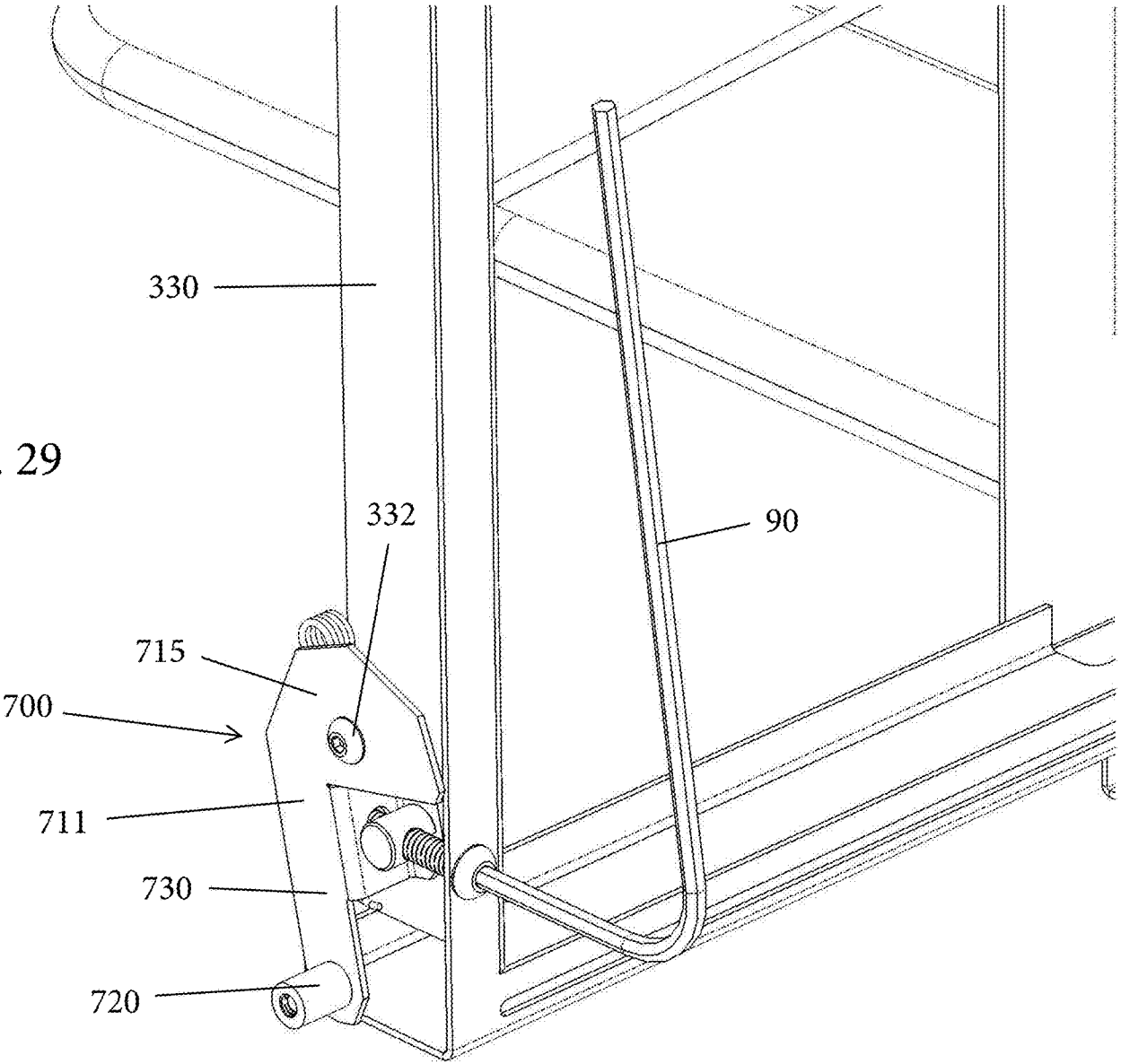
FIG. 29 is a perspective view of a take-up mechanism that is part of the window frame.
Figure 30:
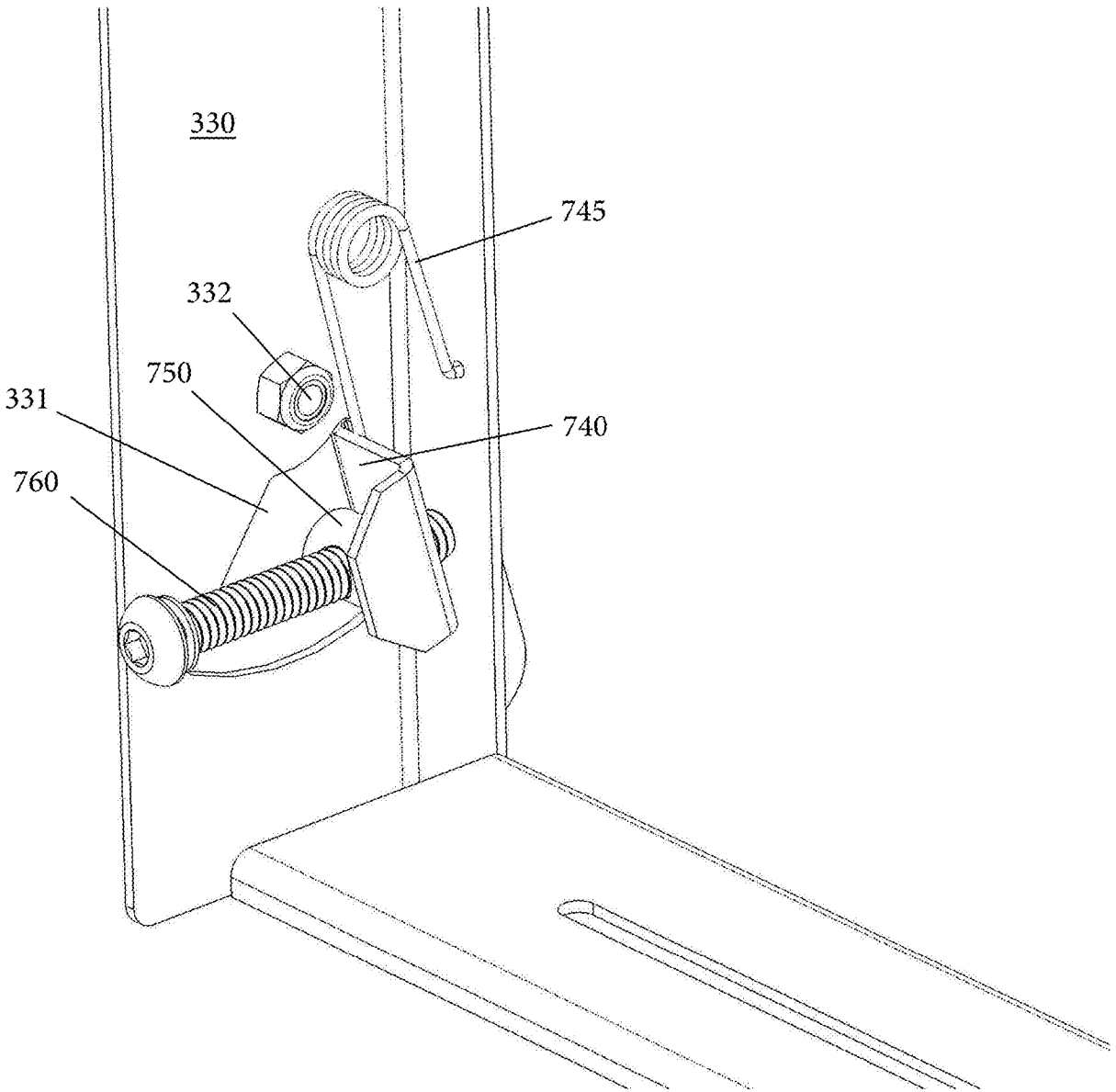
FIG. 30 is another perspective view of the take-up mechanism.
Figure 31:
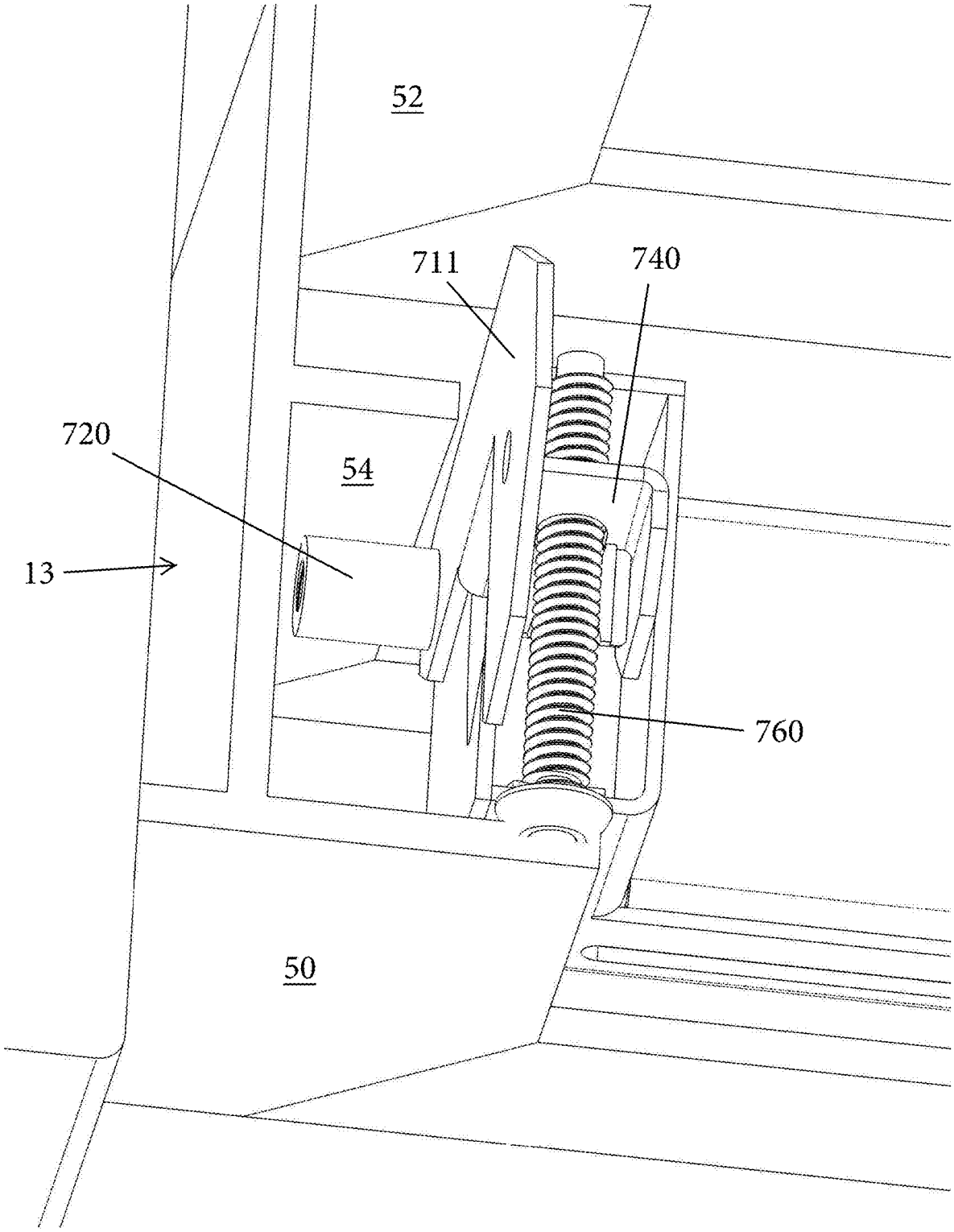
FIG. 31 is a top perspective view of the take-up mechanism.

Take-Up Device 700 (FIGS. 29-31)

One aspect of the window frame 600 that is not found in the window frame 100 is the inclusion of a take-up device 700 that provides an anti-wiggle mechanism for ensuring that the window frame 600 is stabilized within the window 10. The jamb 13 of the window 10 can be though of as including an outer wall 50, an inner wall 52, and an intermediate wall 54 as shown in FIG. 31. The outer wall 50, the inner wall 52, and the intermediate wall 54 are oriented parallel to one another. As shown in FIGS. 29-31, the take-up device 700 is placed within the space that is between the outer wall 50 and the intermediate wall 54.

Figure 14:
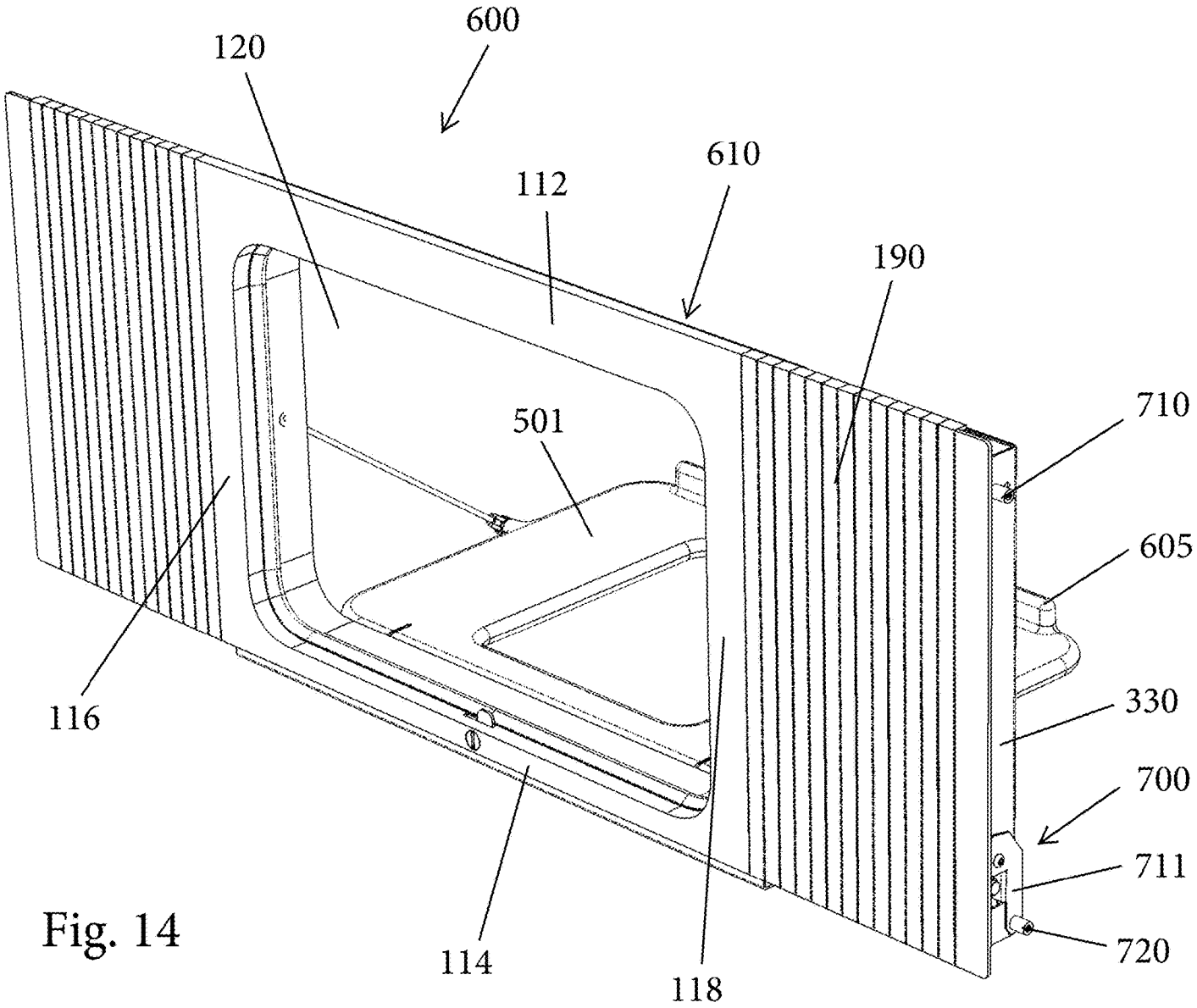
FIG. 14 is a front and side perspective view of a window frame according to a second embodiment with a pop-down shelf in an open position and side support frames in extended positions.

As shown in FIGS. 14 and 15, the take-up device 700 includes a fixed stop 710 in the form of a protrusion that extends outwardly from the end support 330 and is located near a top end thereof. The fixed stop 710 can take any number of different forms including the cylindrical shaped protrusion. The fixed stop 710 seats against the inner face of the outer wall 50 when the window frame 600 is properly inserted into the window 10.

The take-up device 700 includes an adjustable stop 720 that is part of a mechanism that is adjusted by the user to cause the adjustable stop 720 to be driven into and against the outer face of the intermediate wall 54. With the fixed stop 710 seating against the outer wall 50 and the adjustable stop 720 seating against the intermediate wall 54, a secure fit is achieved between the window frame 600 and the window 10. This secure fit prevents the window frame 600 from wiggling in the window 10.

While the figures show the fixed stop 710 being at or near the top of the end support 330 and the adjustable stop 720 being at or near the bottom of the end support 330, it will be appreciated that these two locations can be switched in that the fixed stop 710 can be located at or near the bottom.

The take-up device 700 includes a take-up bracket 711 that has an end portion 715 and a leg 730 that extends outwardly from the end portion 720. The take-up bracket 711 can have an L-shape. At the distal end of the leg 730, the adjustable stop 720 is located and protrudes outwardly therefrom. The direction that the adjustable stop 720 protrudes allows the adjustable stop 720 to be inserted into the space between the outer wall 50 and the intermediate wall 54. The take-up bracket 711 is pivotally (rotatably) coupled to the end support 330 using a pivot 332, such as a pin or fastener or the like. It will be appreciated that as the take-up bracket 711 rotates in a clock-wise direction (See, FIG. 29), the adjustable stop 720 moves a rearward direction toward the intermediate wall 54. Conversely, the take-up bracket 711 rotates in a counter clock-wise direction (See, FIG. 29), the adjustable stop 720 moves in a forward direction toward the outer wall 50.

The end support 330 includes a window 331 that receives an inner tab 740 that is part of the take-up bracket 711. The inner tab 740 extends in an opposite direction relative to the direction that the adjustable stop 720 protrudes. Both the adjustable stop 720 and the inner tab 740 can be formed 90 degrees (normal) to the leg 730. The take-up device 700 includes a biasing element (e.g., spring) 745 that applies a force to the take-up device 700 (i.e., the inner tab 740). The biasing element 745 can be in the form of a torsion spring that is attached at one end to the end support 330.

The take-up device 700 also includes a drive pin 750 that is part of a worm drive mechanism. A worm 760 is included and has a head 762 that is exposed and accessible along the front face of the end support 330. The head 762 can have a traditional pattern, such as a hex pattern. The worm 760 thus passes along a width of the end support 330 and the inner tab 340 can include an opening to allow for passage of the worm 760. The drive pin 750 is disposed in front of the inner tab 340 and mates with the worm 760 (the worm 760 threadingly mates with inner threads within the drive pin 750). The worm 760 and drive pin 750 are designed so that the worm 760 moves the drive pin 750 in a forward and rearward direction. The drive pin 750 is located within the window 331 and since the drive pin 750 is in contact with the inner tab 340, when the drive pin 750 is driven, the take-up bracket 711 rotates about the pivot 332.

The worm 760 is rotates by using a tool 90, such as an Allen wrench. As shown in FIG. 29, when the Allen wrench is turned (rotated), the adjustable stop 720 moves forward or rearward depending upon the direction of rotation. The biasing element 745 applies a force against the drive pin 750.

In use, the user turns the worm 760 with the tool 90 to cause the adjustable stop 720 to move rearward in the window channel between the outer wall 50 and the intermediate wall 54 and when the adjustable stop 720 is driven into contact with the intermediate wall 54, in combination with the fixed stop seating against the outer wall 50, the window frame 600 is prevented from moving rearward.

During removal of the window frame 600, the worm 760 is rotated in the opposite direction with the tool 90 to cause the drive pin 750 to move in the opposite direction resulting in the take-up bracket 711 rotating in the opposite direction and the adjustable stop 720 backs off from the intermediate wall 54.

The window frame 600 also includes the pop-down shelf 501 that is coupled to the window frame 100 and moves between a lowered position and a raised position. The pop-down shelf 501 is thus similar to shelf 500. The pop-down shelf 501 can be coupled to the window frame 600 using the same or similar mechanism (hinged linkages) disclosed with respect to the window frame 100. As shown in FIG. 15, the pop-down shelf 501 can be attached to the main body 610 using a pair of cables 620 instead of the metal hinges used in the first embodiment. Each cable has a first end 622 that is coupled to the main frame body 610 and an opposite second end 624 that is coupled to a side edge of the pop-down shelf 501. As illustrated, the first end 622 can be located within a hollow space formed in the rear face of the main body 610.

Along the exposed rear edge of the shelf 501 there can be a raised protrusion (rail or backstop) 605 that acts as a safety backstop in that this raised edge limits the rearward movement of the air conditioner unit 1000 on the shelf 501. As shown, the raised protrusion 605 extends across a substantial width of the shelf 501 and extends upwardly. This raised protrusion 605 is thus located behind the rear face of the air conditioner unit 1000 that is located outside the building and protects against unintentional excess advancement of the air conditioner unit 1000 into the window frame 600. Thus, the raised protrusion 605 acts as a stop that limits the degree of travel of the air conditioner unit and thus can be referred to as being a backstop.

Like the pop-down shelf 500, the pop-down shelf 501 can include a built-in bracket.

As with the window frame 100, the window frame 600 can also contains insulation 180 and protective covering 190 that is disposed within the open space 340 of each side support frame 300. More particularly, insulation 180 (FIG. 1) can be disposed within the open space 340 (FIG. 3) and can take any number of forms (such as sheet, panel or block form) and can be formed of any number of suitable insulation materials, such as foams, etc.

In addition, the window frame 600 includes covering 190 that is designed to provide a protective and decorative cover over the insulation 180. The covering 190 thus provides an aesthetically pleasing look while also shielding the insulation 180.

As previously discussed, the covering 190 can come in sheet form and as shown, can be formed of a number of strips that are attached in a side-by-side manner and can be (vertically) perforated to allow the covering 190 can be cut to size (customized). In other words, the covering 190 is cut to size by cutting along a perforation (cut line) between two strips or can simply be detached along a scored line (perforation/weakened area of the sheet). The strips of the covering 190 preferably have a height that is greater than a height of the side support frame 300. Thus, when properly installed, the covering 190 extends from the lower horizontal support 320 to a location above the upper horizontal support 310 and more particularly, the covering 190 extends to the upstanding wall or flange or lip 140 to provide a clean look along the front face of the window frame 100.

The covering 190 is attached to the side support frame 300 using the techniques disclosed herein, including utilizing a snap-fit. For example, clips can be used to clip the covering 190 to the respective side support frame 300 (e.g., the customized (cut-to-size) covering 190 can be easily snap-fittingly attached to the side support frame 300 by engaging male/female locking features.

Figure 16:
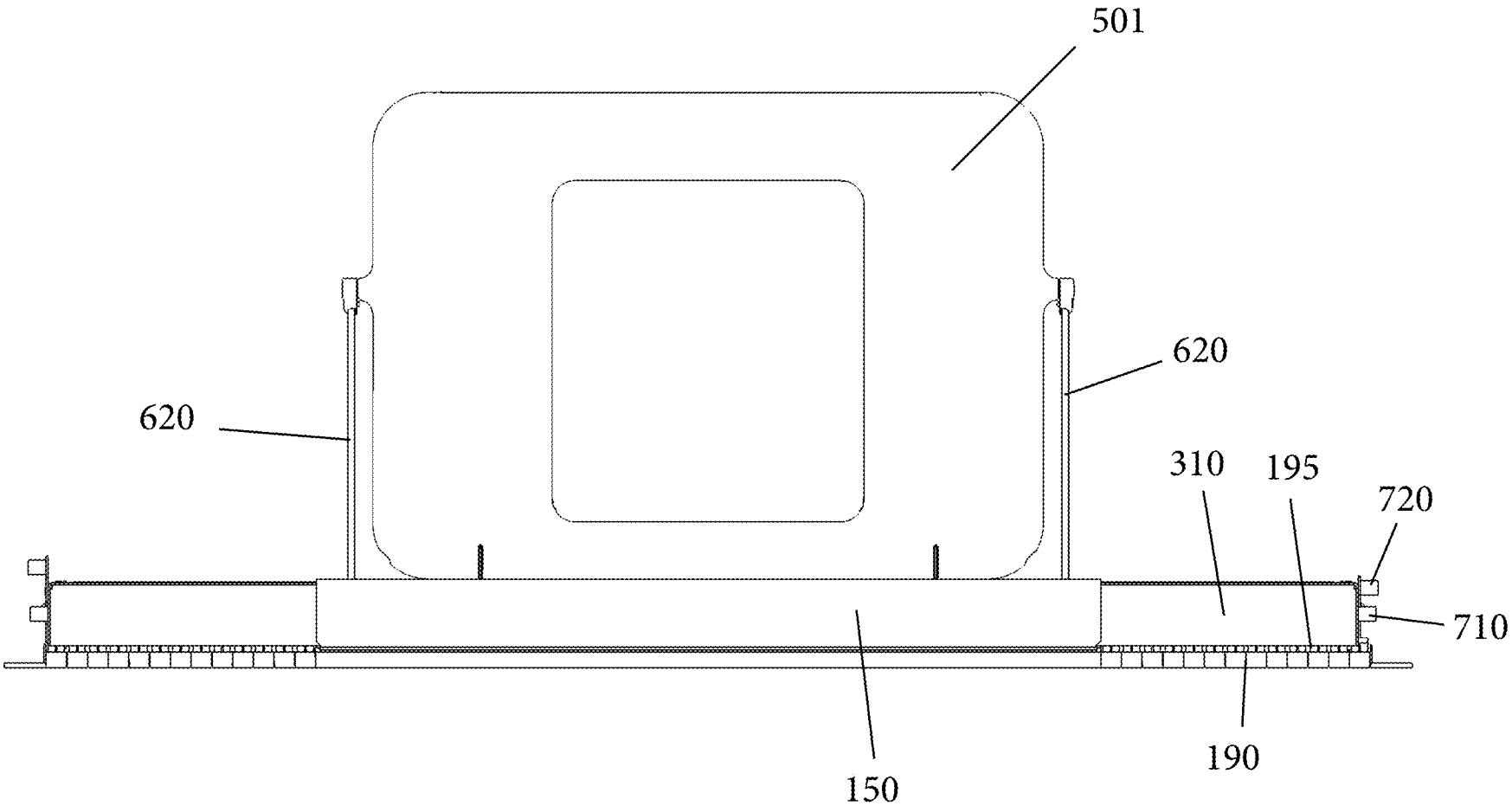
FIG. 16 is a top plan view thereof.
Figure 17:
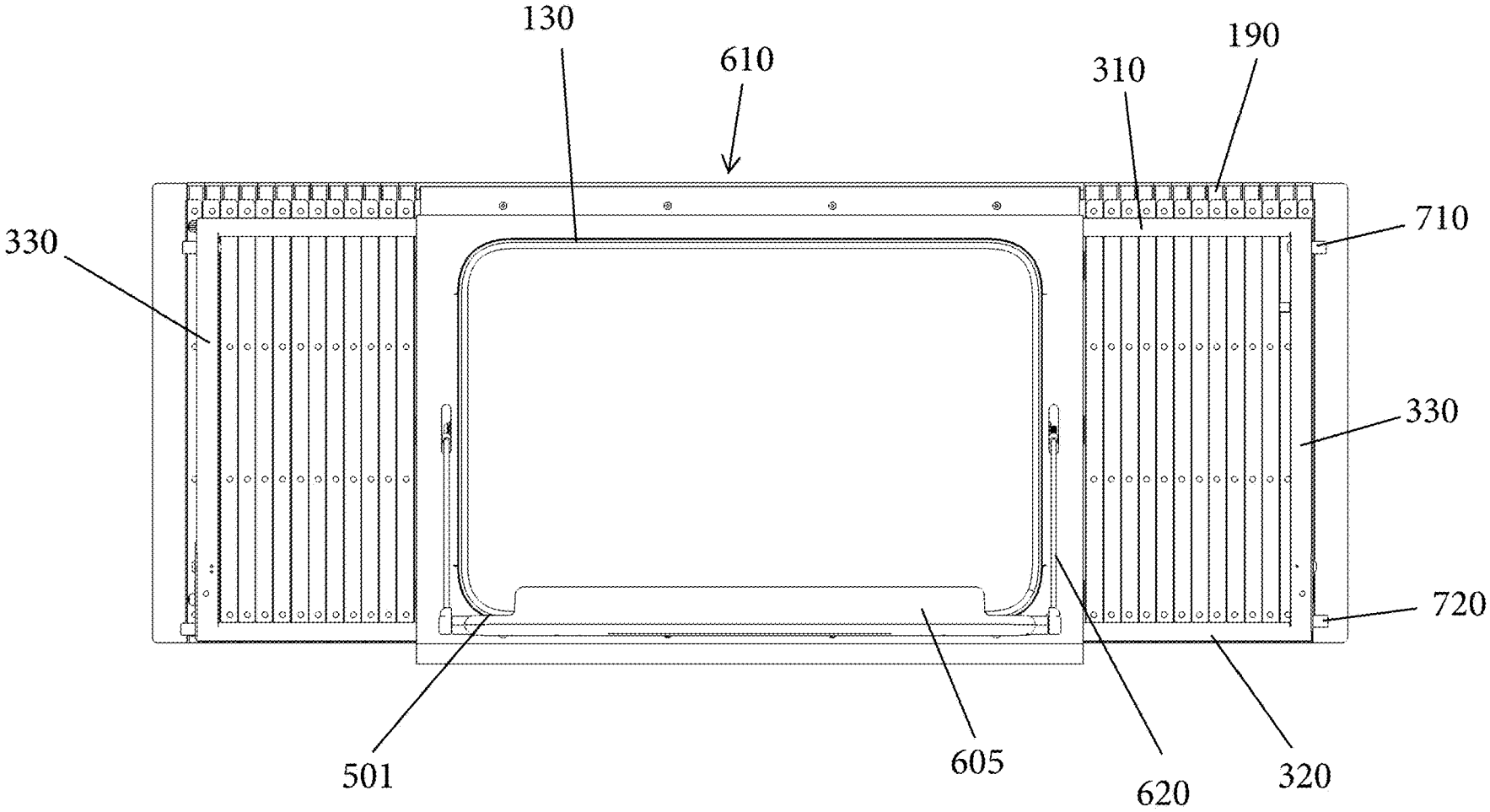
FIG. 17 is a rear elevation view thereof.
Figure 18:
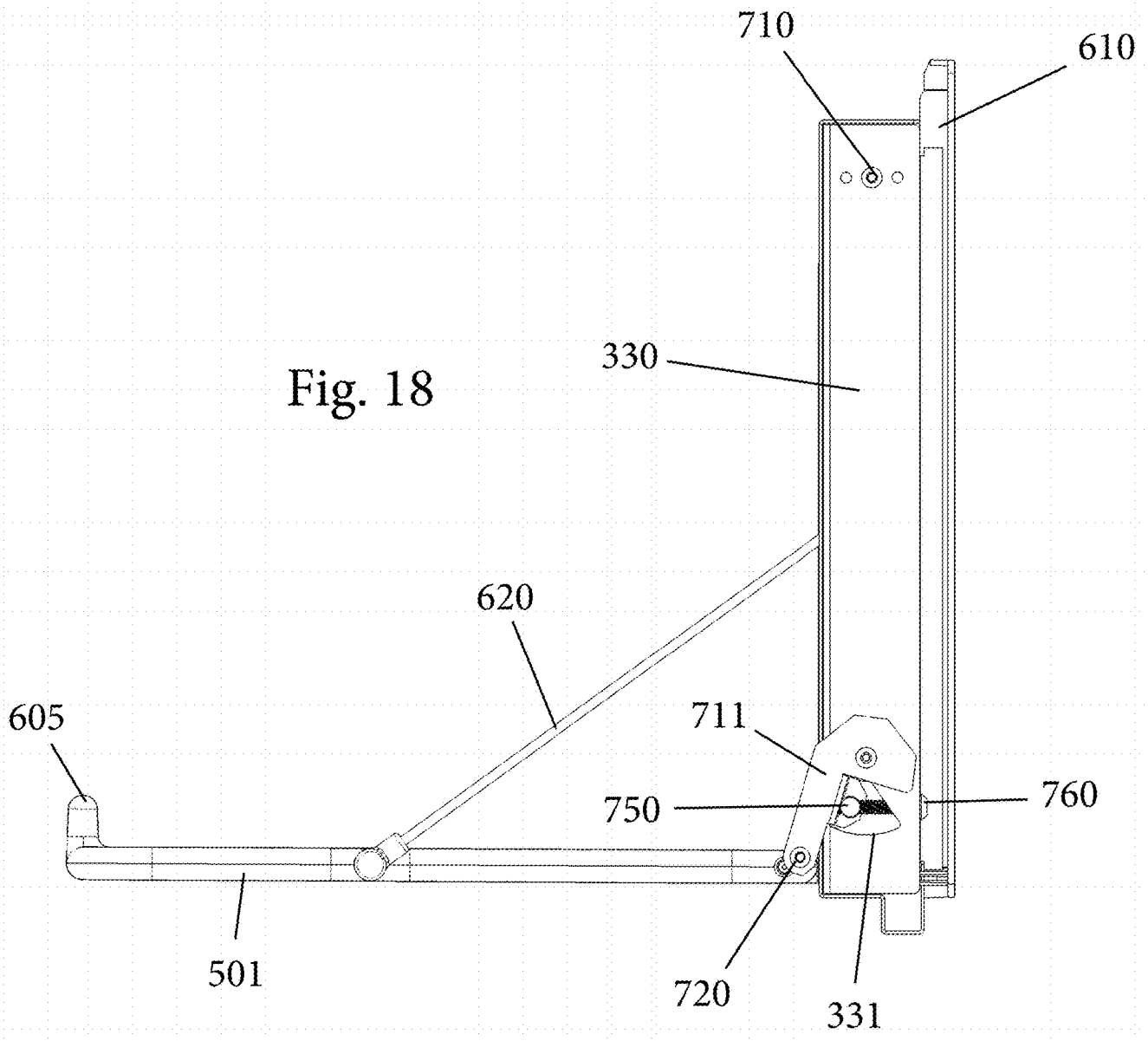
FIG. 18 is a side elevation view thereof.
Figure 19:
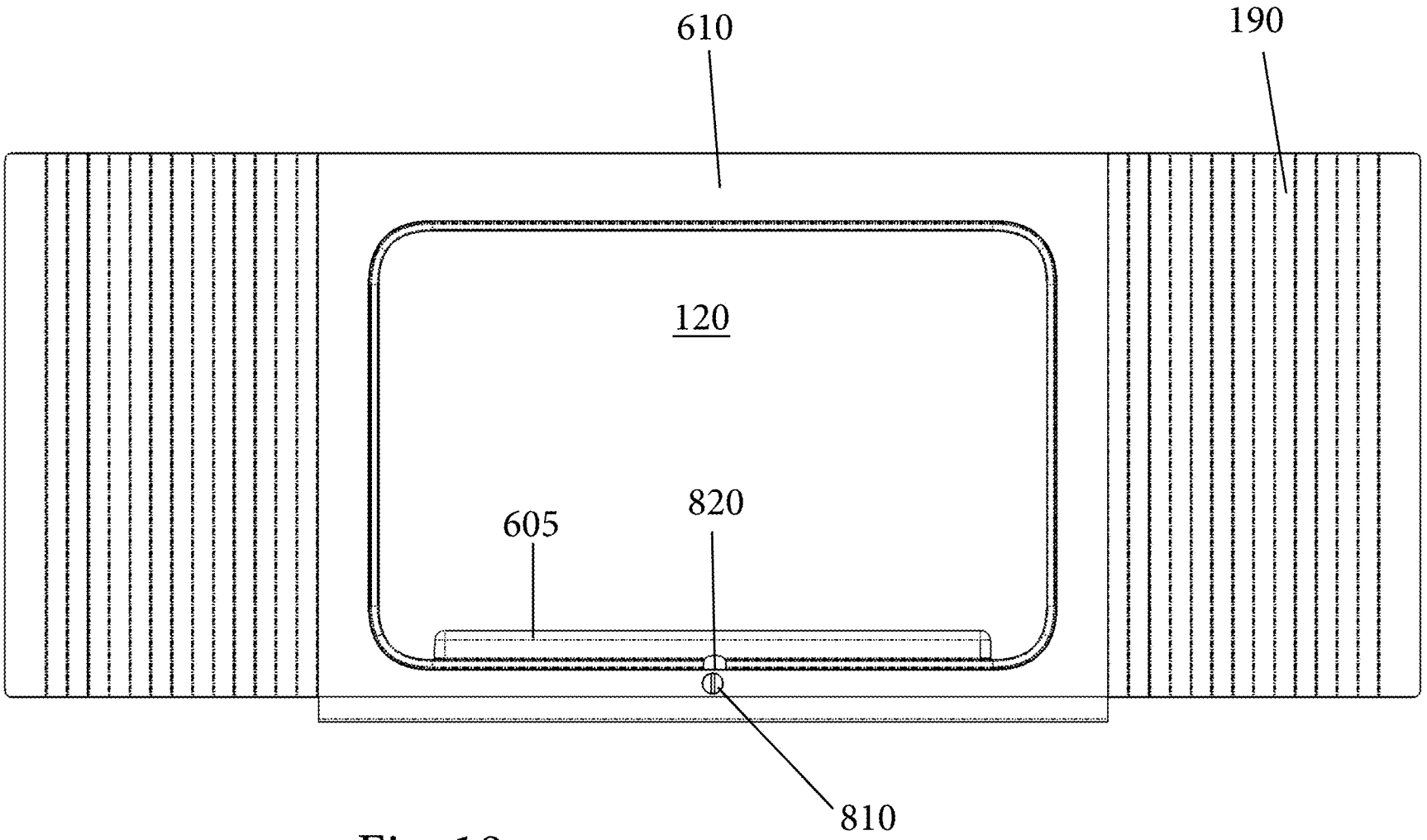
FIG. 19 is a front elevation view thereof.
Figure 20:
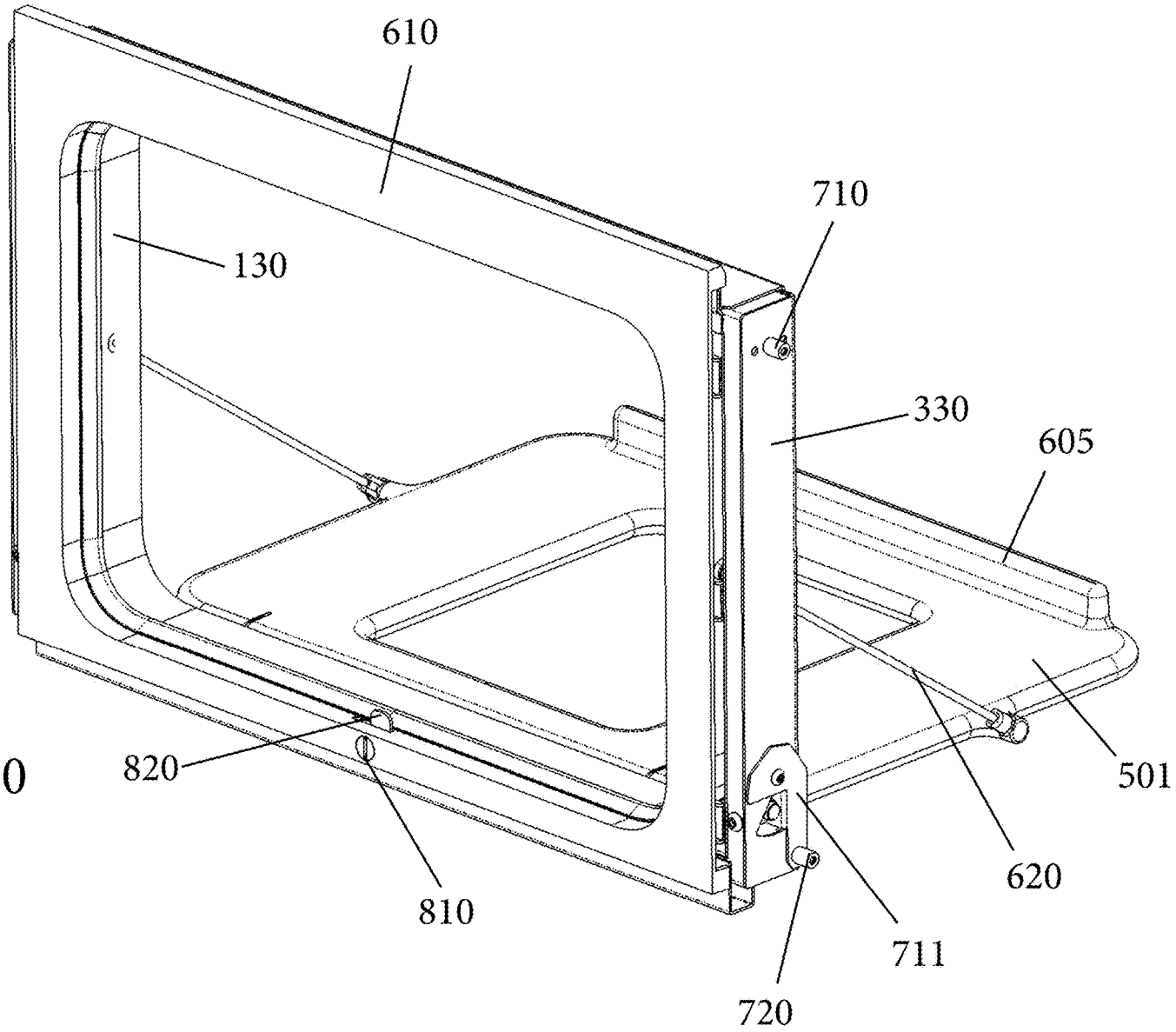
FIG. 20 is a front and side perspective view of a window frame according to the second embodiment with a pop-down shelf in the open position and side support frames in retracted positions.
Figure 21:
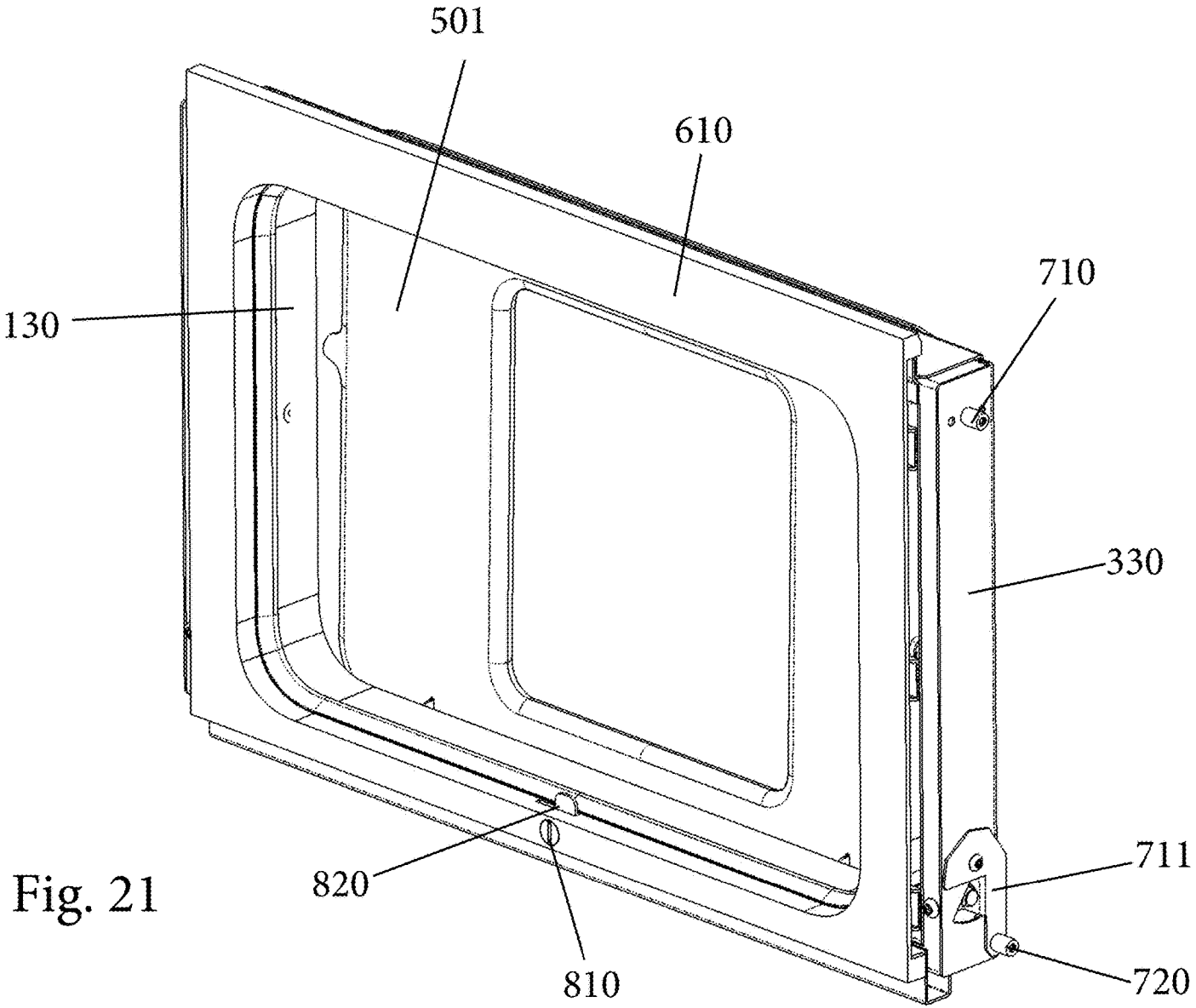
FIG. 21 is a front and side perspective view of a window frame according to the second embodiment with a pop-down shelf in the closed position and side support frames in retracted positions.
Figure 22:
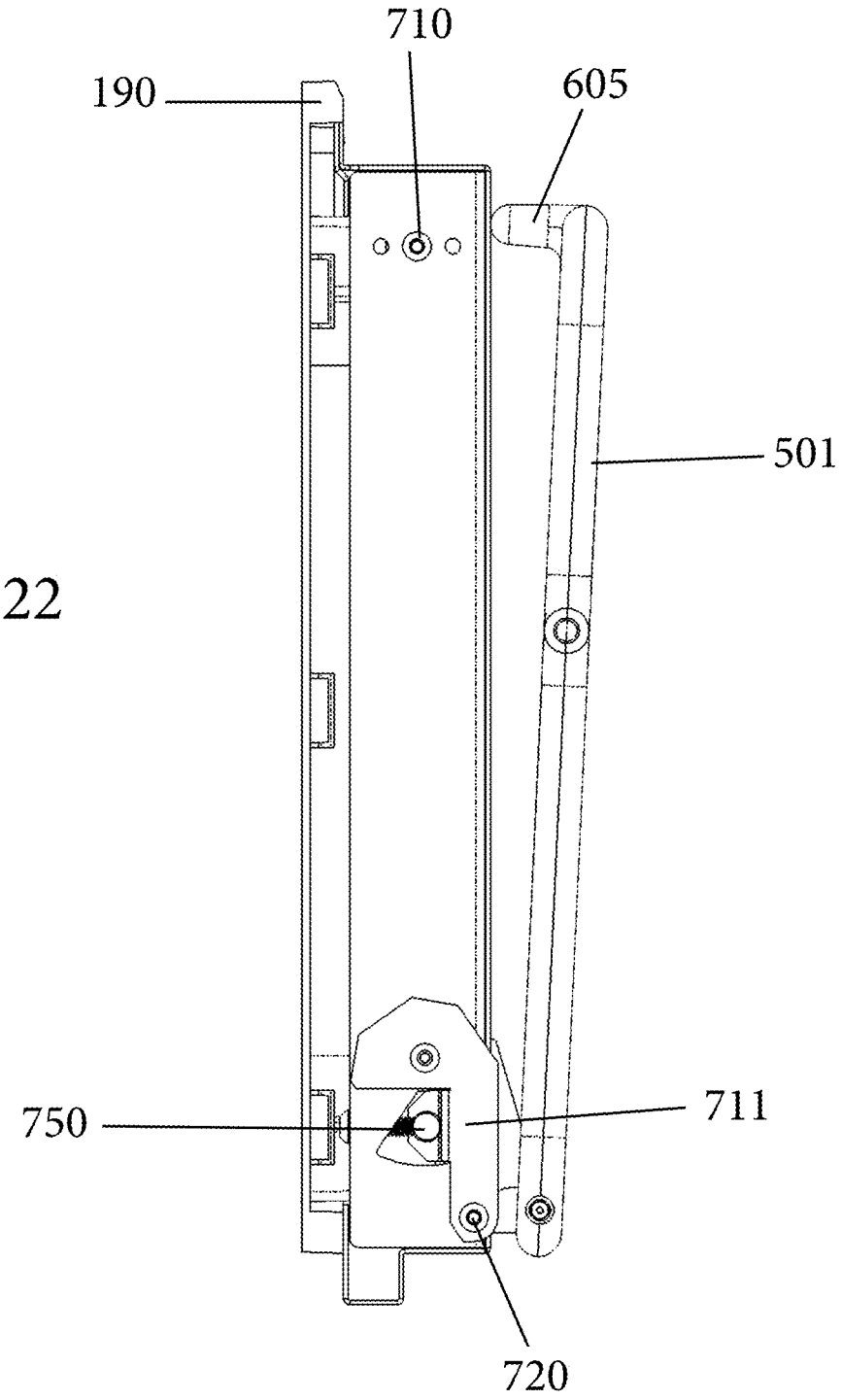
FIG. 22 is side elevation view thereof.

FIGS. 15 and 16 illustrate another manner of attaching the covering 190 to the upper horizontal support 310 and the lower horizontal support 320. Unlike the first embodiment shown in FIGS. 1-13, the female locking features associated with the upper horizontal support 310 and the lower horizontal support 320 are not located along the top surfaces of these two supports 320 but instead, the female features are located along the front faces (front surfaces) of the two supports 320. For example, the plurality of openings or continuous slot (like openings or slot 321) is formed along the front face of each of the two supports 310, 320. The male feature which can be in the form of a locking clip or protrusion 195 (FIG. 16) is inserted into the front facing openings or continuous slot and snap-fitting mates thereto much like the reception of clips 325 into openings/slot 321 in the first embodiment. The protrusion 195 can be a prong that has a locking tab or catch that snap-fits into the openings/slot formed in the front face of each support 310, 320. Thus, there are two rows of clips 195 with one row being inserted into the slot formed in the front face of the upper horizontal support 310 and the other row being inserted into the lower horizontal support 320. In this way, the covering 190 is snap-fittingly secured to both the upper horizontal support 310 and the lower horizontal support 320.

In this way and much like the first embodiment, the customized (cut-to-size) covering 190 can be easily snap-fittingly attached to the side support frame 300 by engaging male/female locking features.

The adjustable side panel supports 300 are thus designed to fill the open space within the window frame 10. The coverings 190 likewise decoratively cover this space as well as they are mounted to the side panel supports 300.

It will be appreciated that the covering 190 is easily detached and can be interchanged with over coverings 190 and therefore, the user can easily customize the window frame 100. For example, the coverings 190 can come in different colors, different patterns, having different prints formed thereon, have different textures, etc. While the default color of the covering 190 is the same color as the window frame 100, other colors can be offered to provide a contrast in the color of the coverings 190 and the rest of the window frame 100.

The foam 180 can be tear-away weatherproof foam and the covering 190 can be made of a plastic material.

It will be understood that other structures can be used to fill the open space defined by and within the extended side panel supports 300. For example, only insulation 180 can be used and the covering 190 can be eliminated or another material can be used to fill and plug this open space.

Figure 33:
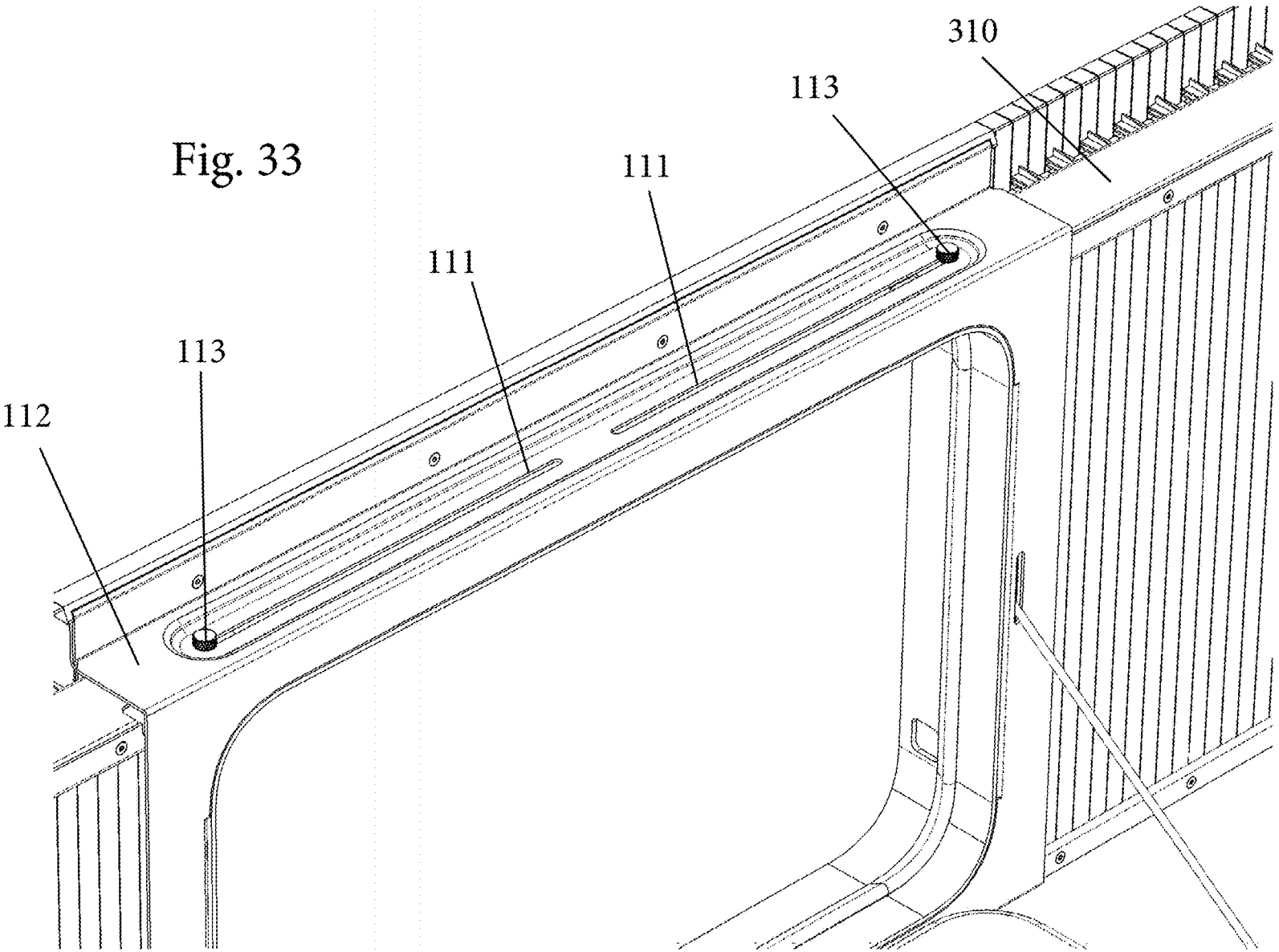
FIG. 33 is a partial top perspective view of the window frame showing fasteners for securing the side support panels in a desired degree of extension.

As shown in FIG. 33, the window frame 600 (as wells as the window frame 100) can include a means for retaining the adjustable side panel supports 300 in desired locations. For example, the top wall 112 of the frame body 110 can include one or more slots 111 that extend across the top wall 112. In the illustrated embodiment, there are two slots 111 with a center portion of the top wall 112 being solid between ends of the two slots 111. The two slots 111 provide access into the hollow track(s) into which the upper horizontal supports 310 are located. As shown in FIG. 33, a fastener 113 or other securing element can be inserted through one respective slot 111 and into contact with the upper horizontal support 310 for securing the side panel support 300 in place at a chosen degree of extension from the main frame body. The fastener 113 can be in the form of a thumb screw or the like. It will be appreciated that a pair of fasteners 113 are used, one for each side panel support 300. In this manner, one the user inserts the window frame 100 into the window 10 and extends the side panel supports 300, the fasteners 113 can be used to secure/lock the side panel supports 300 in place. It will also be appreciated that the weight of the air conditioner unit and the design of the frame 100 provides for additional securement of both of these components in the window 10. To remove the frame 600, the steps are reversed and the fasteners 113 are loosened and the side panel supports 300 are pushed inward to clear the window jambs.

Air Conditioner Unit 1000 (Second Embodiment)

Figure 23:
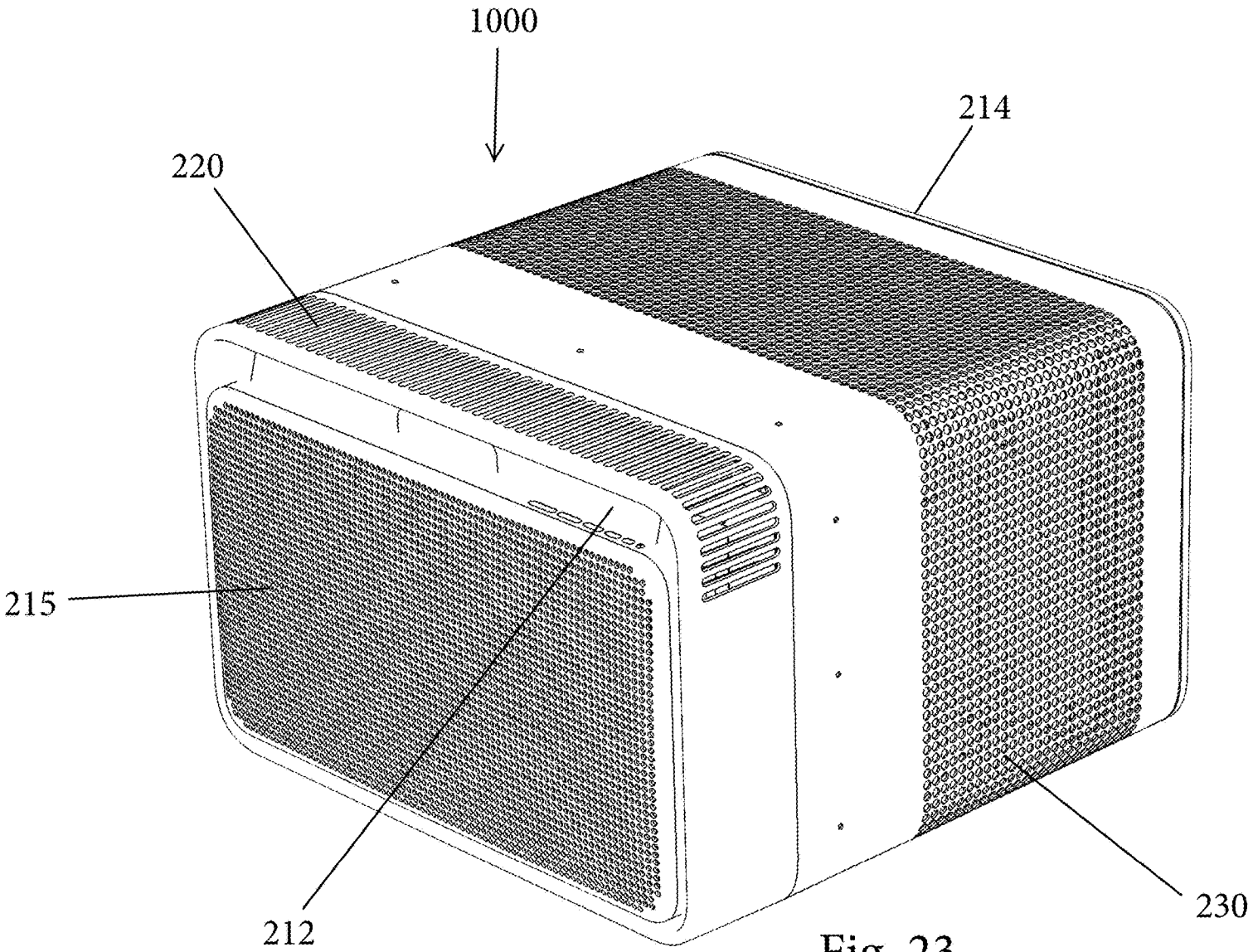
FIG. 23 is a front and side perspective view of an exemplary air conditioner unit.
Figure 24:
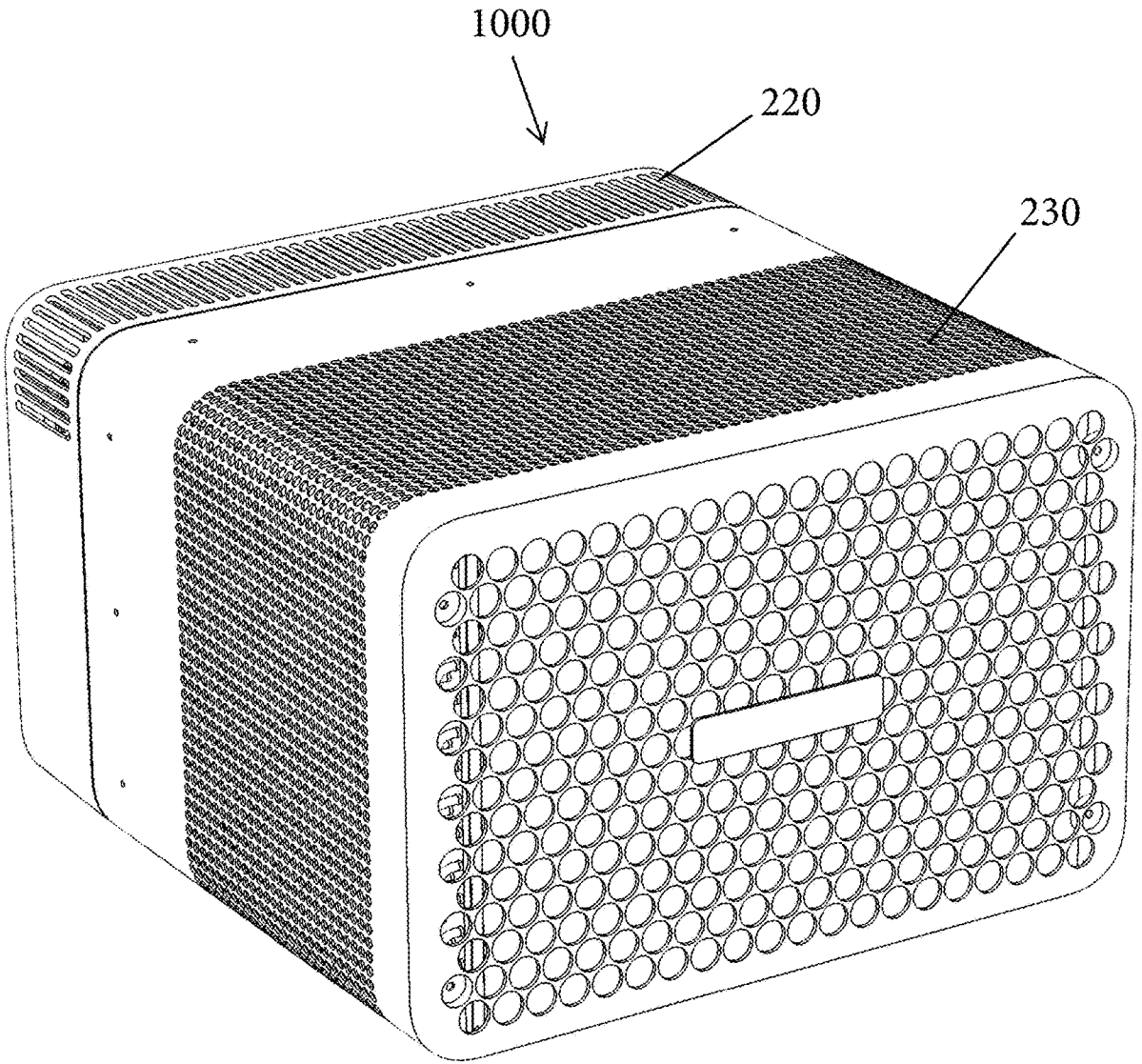
FIG. 24 is a rear and side perspective view thereof.
Figure 25:
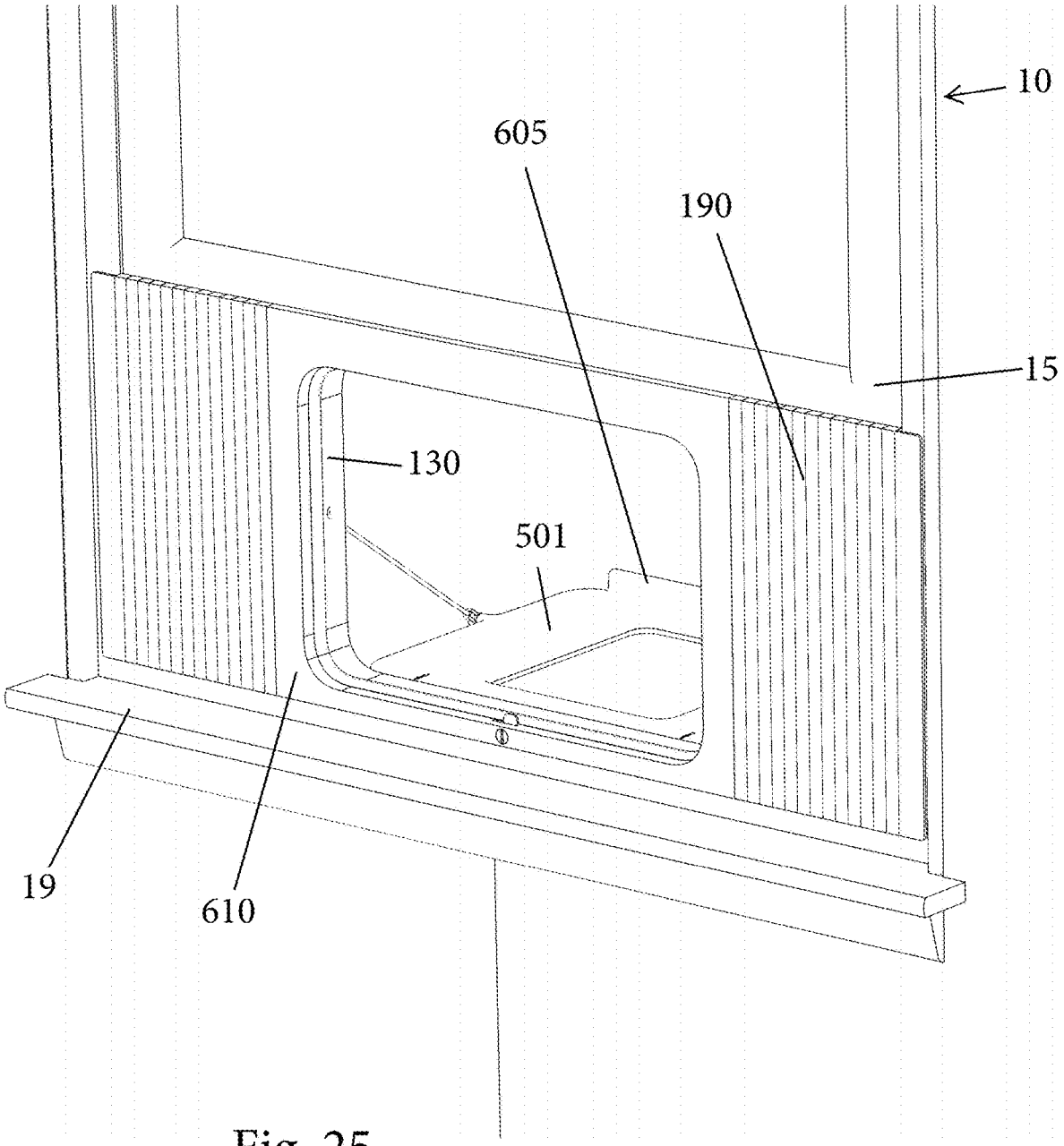
FIG. 25 is a front perspective view of the window frame installed into a window.
Figure 26:
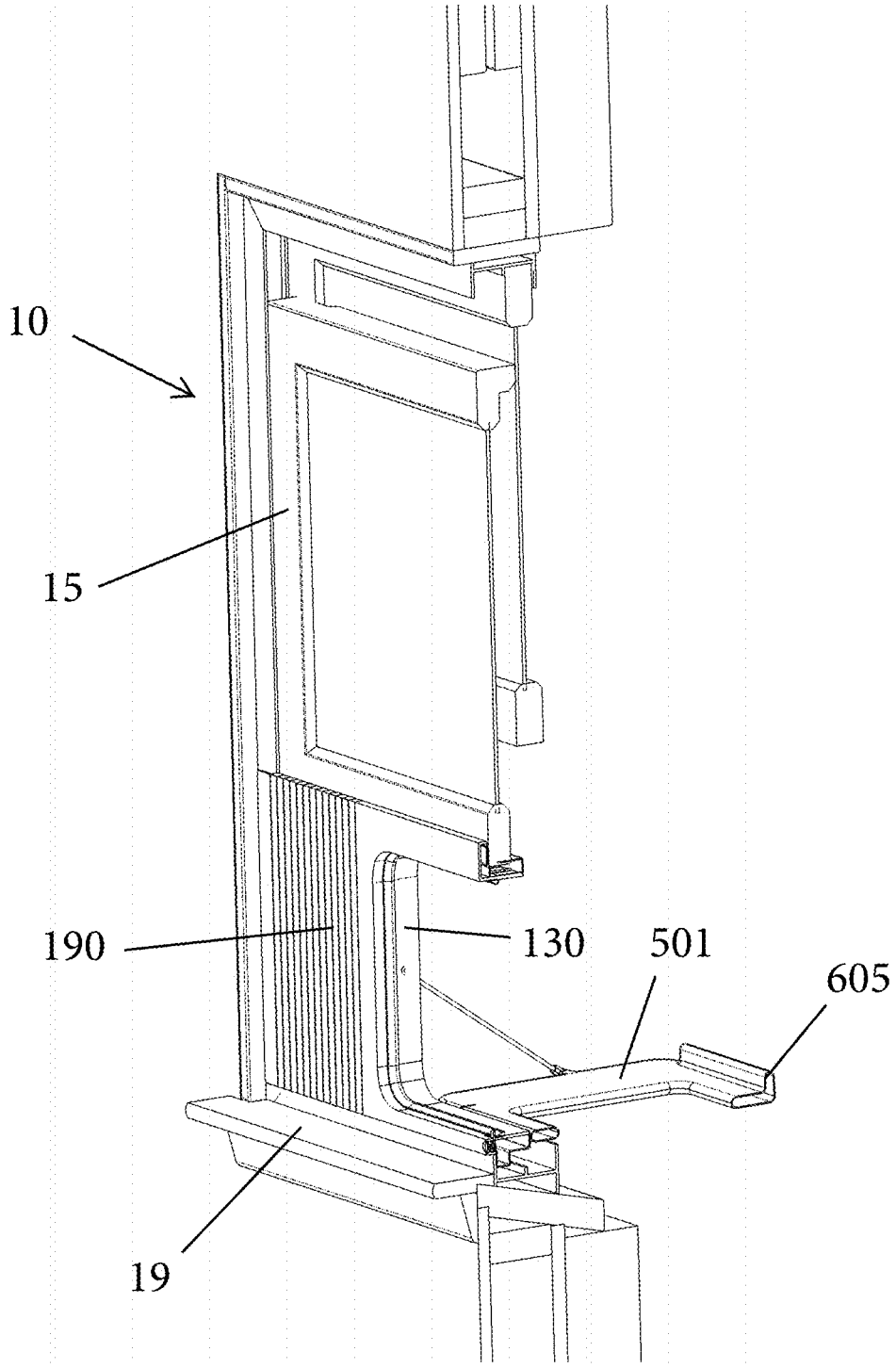
FIG. 26 is a perspective view, in cross-section, of a portion of the window frame installed into the window.
Figure 27:
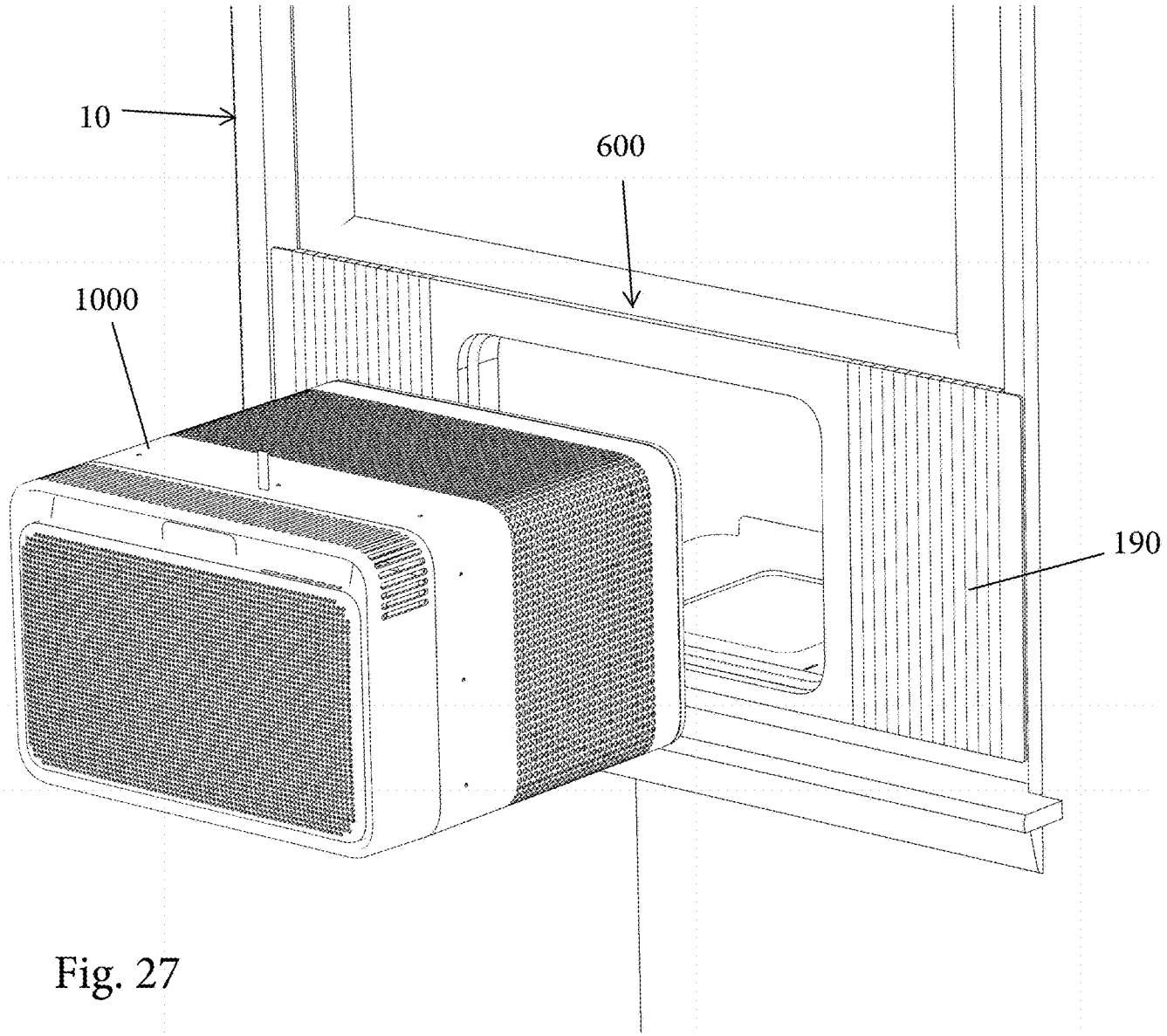
FIG. 27 is a front perspective view of the window frame installed into the window with the air conditioner unit being shown exploded from the window frame.
Figure 28:
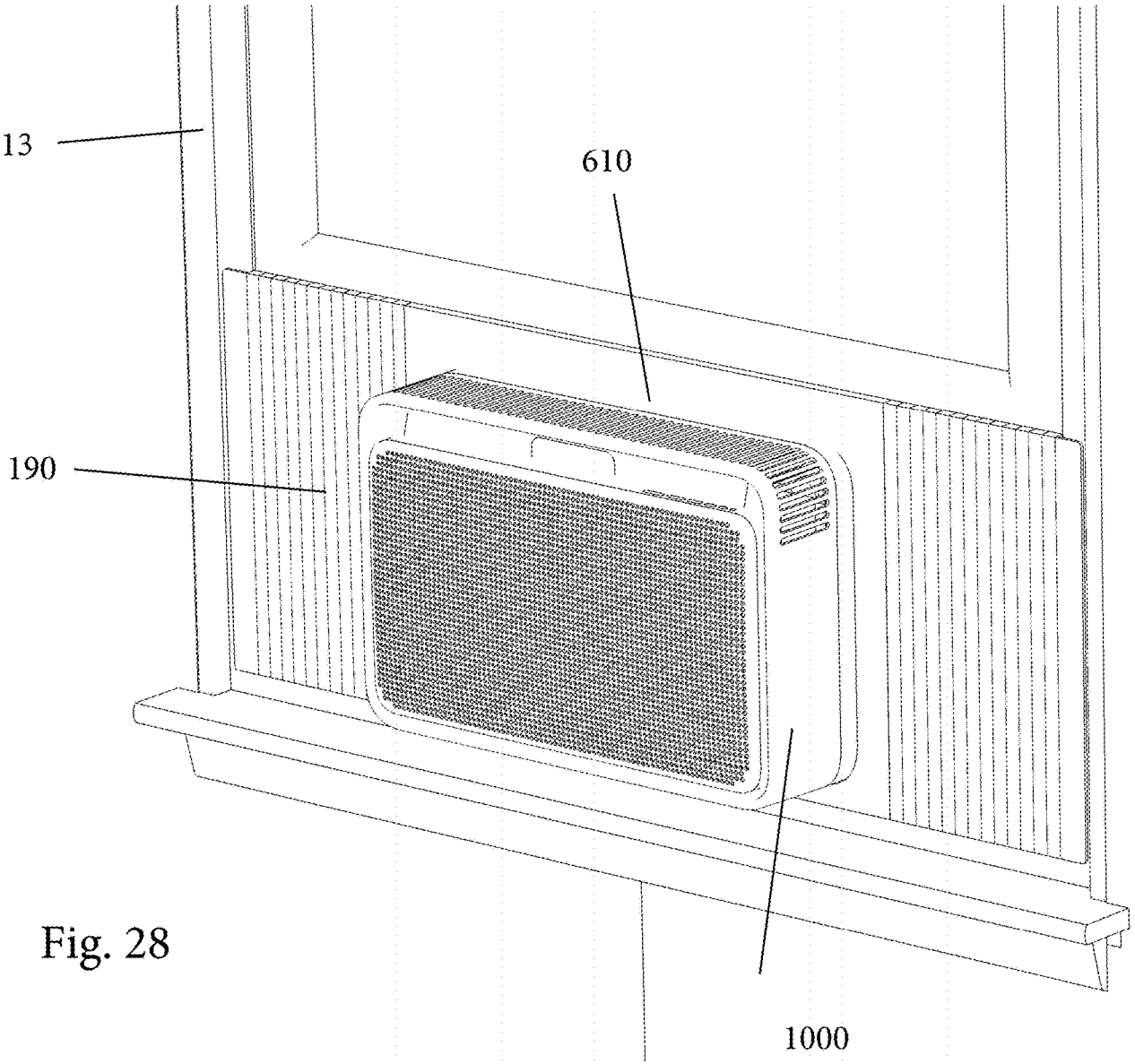
FIG. 28 is a front perspective view of the window frame installed into the window with the air conditioner unit being installed into the window frame.
Figure 32:
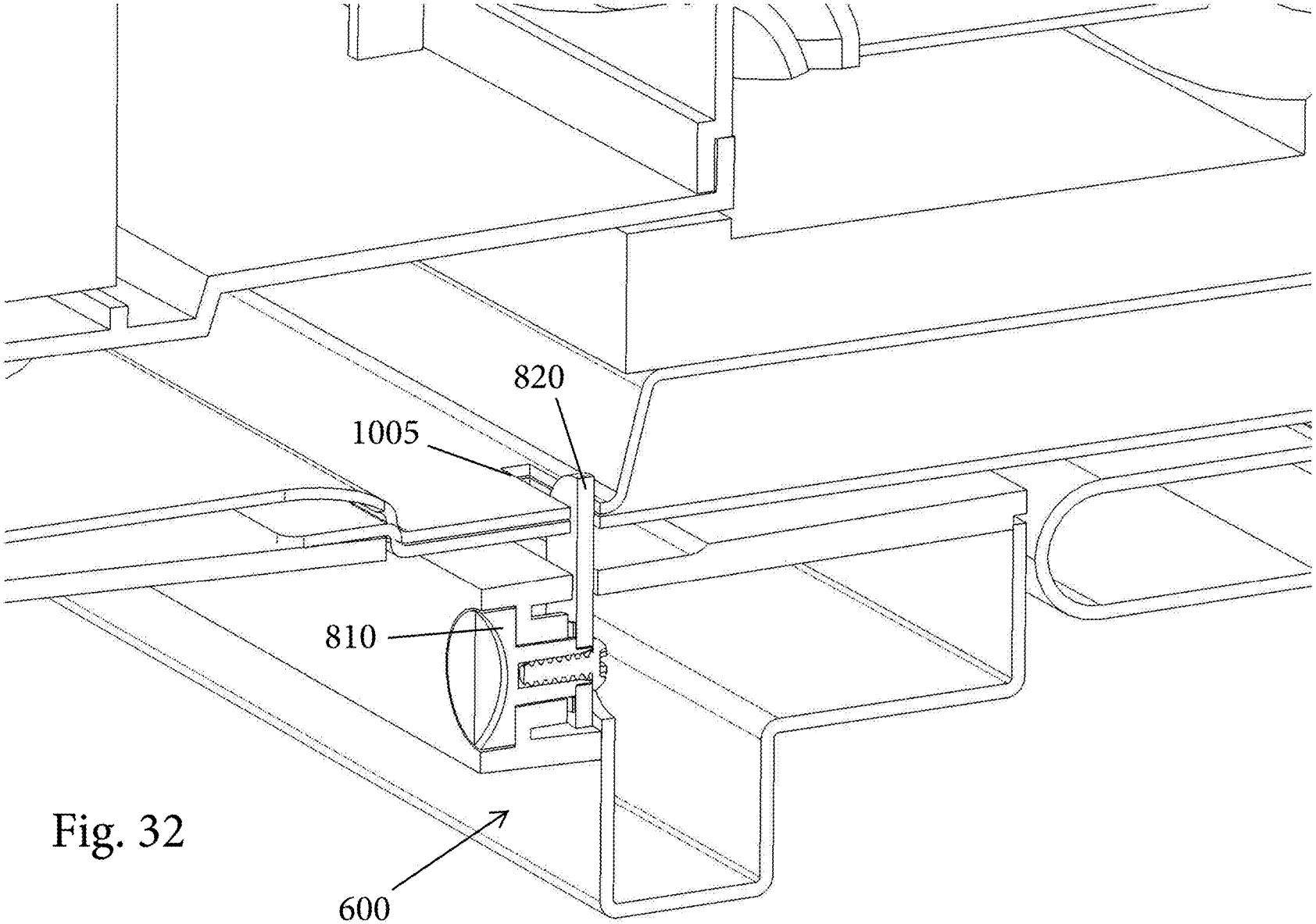
FIG. 32 is a perspective view, in cross-section, of the AC lock device.

FIGS. 23 and 24 illustrates air conditioner unit 1000 which is very similar to the air conditioner unit 100 and therefore, like elements are numbered alike. Unlike the unit 100, the unit 1000 does not include the notches/channels 250. As shown in FIG. 32, the underside of the air conditioner unit 1000 can include one or more slots 1005 formed in the basepan of the air conditioner unit 1000.

Air Conditioner Lock Device

The window frame 600 includes a mechanism to ensure that the air conditioner unit 1000 remains locked to the window frame 600. The window frame 600 includes a lock device 800 that includes an actuator 810 and a pivotable tab 820. The actuator 810 is located along the front of the window frame 600 and is freely accessible by the user. The actuator 810 is operatively coupled to the pivotable lock tab 820 such that rotation of the actuator 810 results in rotation of the lock tab 820 between a fully retracted position and a fully extended position (FIG. 32). The actuator 810 can be of a quarter turn construction in that a quarter turn rotation of the actuator 810 causes the lock tab 820 to move between the two positions. When the lock tab 820 is in the fully extended position, the lock tab 820 is received within the slot 1005.

The actuator 810 can thus be in the form of a quarter-turn screw with a slot for a coin or screwdriver. The lock tab 820 thus interferes with the basepan of the AC unit 1000 thus preventing movement of the AC unit 1000 in and out of the window frame 600.

It will be appreciated that the frames 100, 600 can be formed of any number of suitable materials, including plastic and/or a combination of metal and plastic.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A frame for insertion into a window frame and configured to hold a window air conditioner unit comprising: a main frame body having an opening formed therein for receiving the air conditioner unit; a pair of adjustable side support frames that are slidingly coupled to the main frame body for filling an open window space of the window frame; each side support frame moving between: (1) a retracted position in which the side support frame is retracted within upper and lower internal channels that are formed within the main frame body and are open along opposite sides of the main frame body and (2) an extended position in which the side support frame extends radially outward from the side of the main frame body a distance greater than when the side support frame is in the retracted position; each of the side support frames includes a take-up device for securing the frame within a window channel of the window frame, the take-up device having a fixed stop for contacting a first wall defining the window channel and an adjustable stop that can be moved in a forward-rearward direction for contacting a second wall defining the window channel; and a drop-down shelf that is pivotally coupled to the main frame body and moves between a lowered position in which the air conditioner unit is supported on the drop-down shelf and a raised position in which the drop-down shelf at least partially closes off the opening formed in the main frame body.

2. The frame of claim 1, wherein the main frame includes a forward portion and a rear portion in the form of a continuous rearwardly extending flange that surrounds and defines, in part, the opening.

3. The frame of claim 1, wherein the opening has curved corners.

4. The frame of claim 1, wherein each of the side support frames includes an upper horizontal support that slidingly travels within an upper internal channel formed within a top wall of the main frame body; a lower horizontal support that slidingly travels within a lower internal channel formed in a bottom wall of the main frame body and a vertical end support that extends between and is coupled to the upper and lower horizontal supports, with a first open space being formed between the upper and lower horizontal supports and vertical end support.

5. The frame of claim 4, further including an insulation disposed within the first open space of each of the side support frames and a customizable covering that covers the insulation and is coupled to the respective side support frame.

6. The frame of claim 5, wherein the covering comprises a plurality of detachable strips that are arranged and connected to one another in a side-by-side manner, the covering being sized to fit within and cover the first open space by separating one or more of the detachable strips to size the plurality of strips such that a width of the plurality of detachable strips is at least equal to a width of the first open space.

7. The frame of claim 5, wherein the covering includes a first coupling member for detachably coupling the covering to the side support frame by mating with a second coupling member that is part of the side support frame.

8. The frame of claim 7, wherein the first coupling member comprises a plurality clips that protrude outwardly from a rear face of the covering and the second coupling member comprises one of a plurality of openings and an elongated slot formed in the upper horizontal support of the side support frame.

9. The frame of claim 5, wherein the plurality of detachable strips is snap-fit is coupled to the respective side support frame by a snap-fit.

10. The frame of claim 5, wherein the covering extends from the lower horizontal support to a location above the upper horizontal support, the covering being attached to the side support frame in a snap-fit manner.

11. The frame claim 1, wherein the take-up device includes: (1) a take-up bracket that is pivotally coupled to an outer end wall of the side support frame, the adjustable stop protruding outwardly from the take-up bracket; and (2) an actuator for pivoting the take-up bracket.

12. The frame of claim 11, wherein the take-up bracket is biased by a biasing element that is in contact with the side support frame and the actuator is accessible along a front face of the frame.

13. The frame of claim 11, wherein the actuator comprises a worm drive that engages an inner tab that is a part of the take-up bracket for driving the take-up bracket in the forward-rearward direction resulting in the adjustable stop moving in the forward-rearward direction.

14. The frame of claim 13, wherein the outer end wall of the side support frame includes a window through which the inner tab extends, with the take-up bracket being disposed along an outer face of the outer end wall and the actuator being disposed along an inner face of the outer end wall.

15. A frame for insertion into a window frame and configured to hold a window air conditioner unit comprising: a main frame body having an opening formed therein for receiving the air conditioner unit; a pair of adjustable side support frames that are slidingly coupled to the main frame body for filling an open window space of the window frame; each side support frame moving between: (1) a retracted position in which the side support frame is retracted within upper and lower internal channels that are formed within the main frame body and are open along opposite sides of the main frame body and (2) an extended position in which the side support frame extends radially outward from the side of the main frame body a distance greater than when the side support frame is in the retracted position; and wherein each of the side support frames includes a take-up device for securing the frame within a window channel of the window frame, the take-up device having a fixed stop for contacting a first wall defining the window channel and an adjustable stop that can be moved in a forward-rearward direction for contacting a second wall defining the window channel.

16. A frame for insertion into a window frame and configured to hold a window air conditioner unit comprising:

a main frame body having an opening formed therein for receiving the air conditioner unit; and a pair of adjustable side support frames that are slidingly coupled to the main frame body for filling an open window space of the window frame; wherein each of the side support frames includes a take-up device for securing the frame within a window channel of the window frame, the take-up device having a fixed stop fixedly attached to the side support frame and an adjustable stop that is movable in a forward-rearward direction, the take-up device further including an actuator that is accessible to a user along the main frame body and is configured to move the adjustable stop in the forward-rearward direction.

17. The frame of claim 16, wherein each side support frame moves between: (1) a retracted position in which the side support frame is retracted within upper and lower internal channels that are formed within the main frame body and are open along opposite sides of the main frame body and (2) an extended position in which the side support frame extends radially outward from the side of the main frame body a distance greater than when the side support frame is in the retracted position.

18. A method of installing an air conditioner unit into a window frame that includes a window channel defined by a first wall and a second wall parallel to the first wall, the method comprising the steps of:

inserting an air conditioner unit frame into an opening defined in the window frame;

extending side support frames of the air conditioner unit frame until they contact jambs of the window frame, each extended side support frame defining an open space;

covering the open space of each side support frame; and using a take-up device to secure the frame within the window channel of the window frame, the take-up device having a fixed stop fixedly attached to a respective side support frame and an adjustable stop that is movable in a forward-rearward direction, the fixed stop being placed in contact with the first wall and the adjustable stop being adjusted until the adjustable stop contacts the second wall.

* * * * *